United States Patent [19]

van der Lely

[11] 4,000,588

[45] Jan. 4, 1977

[54] SPACE-BOUNDING SECTIONS FOR FORMING A BUILDING OR PART THEREOF, AND METHODS OF ERECTING SUCH A BUILDING

[76] Inventor: Cornelis van der Lely, 7, Bruschenrain, Zug, Switzerland

[22] Filed: Dec. 26, 1974

[21] Appl. No.: 536,467

Related U.S. Application Data

[63] Continuation of Ser. No. 336,731, Feb. 28, 1973.

[30] Foreign Application Priority Data

Feb. 28, 1972 Netherlands ..... 7202542

[52] U.S. Cl. ..... 52/71; 52/90

[51] Int. Cl.[2] ..... E04B 1/346

[58] Field of Search ..... 52/71, 79, 64, 68, 69, 52/66, 641, 234, 236, 90

[56] References Cited

UNITED STATES PATENTS

| | | | |
|---|---|---|---|
| 1,407,462 | 2/1922 | Fasson | 52/71 |
| 2,325,747 | 8/1943 | Dailey | 52/71 |
| 3,348,344 | 10/1967 | Tatevossian | 52/79 X |
| 3,470,060 | 10/1969 | van der Lely et al. | 52/79 |
| 3,484,999 | 12/1969 | van der Lely | 52/79 |
| 3,500,596 | 3/1970 | Anderson | 52/79 |
| 3,605,355 | 9/1971 | Solesbee | 52/641 X |
| 3,653,165 | 4/1972 | West | 52/71 X |
| 3,708,200 | 2/1973 | Richards | 52/71 X |

*Primary Examiner*—Price C. Faw, Jr.
*Assistant Examiner*—Carl D. Friedman
*Attorney, Agent, or Firm*—Mason, Mason & Albright

[57] ABSTRACT

This invention relates to space-bounding sections for forming a building or part thereof and adapted to be transported from a factory to a building site.

47 Claims, 42 Drawing Figures

Figure 1:
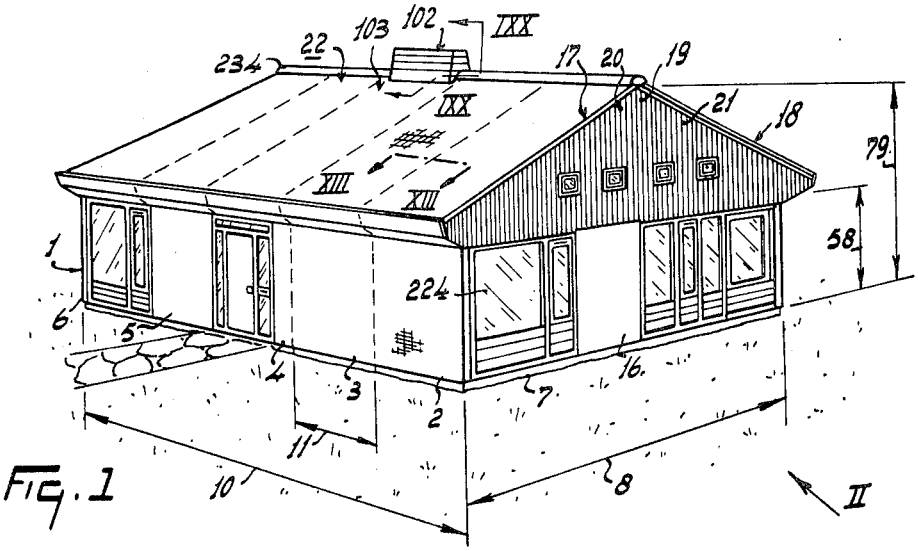

18
24
25
56
13
27
28
29
26
32
31
30
43
44
55
222
220
45
46
52
54
53
15
225
46

17
34
33
63
63
20
216
222
84
85
38
56
39
86
51
51
13
55

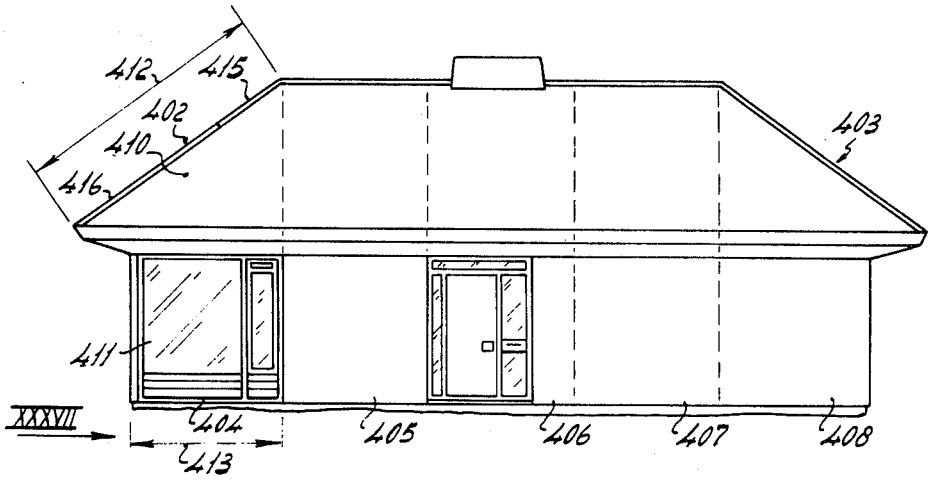
FIG. 36
FIG. 37
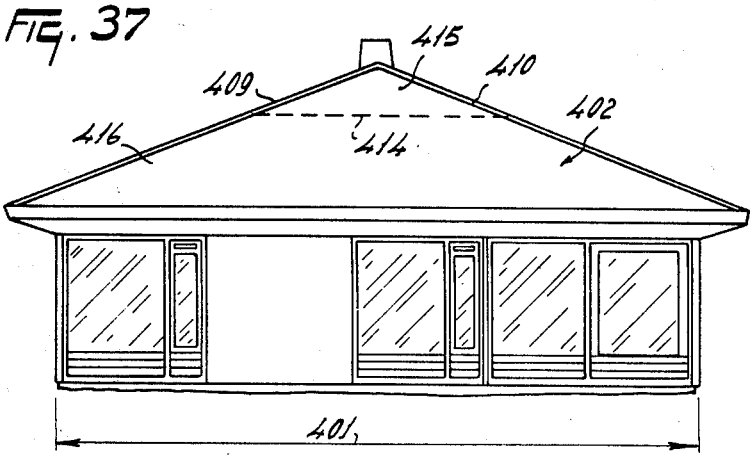

SPACE-BOUNDING SECTIONS FOR FORMING A BUILDING OR PART THEREOF, AND METHODS OF ERECTING SUCH A BUILDING

This is a continuing application of application Ser. No. 336,731 filed Feb. 28, 1973.

According to one aspect of the present invention there is provided a space-bounding section for forming a building or part thereof and adapted to be transported from a factory to a building site, wherein a wall of a further space is displaceably arranged on the section so that for transport purposes it can be arranged near one of the boundary faces of the section and can be moved with respect to the section into a final position in which it is erected on the section.

According to another aspect of the present invention there is provided a method of constructing a building from a plurality of space-bounding sections, in which at least one or more of the sections is (are) moved towards one or more other sections for assembling the building, wherein before one or more of the section is (are) moved into the final position a wall or roof structure is erected on this (these) sections in order to obtain a bounded space above the section, after which the section (s) is (are) moved into their final positions side by side.

Where reference is made herein to a roof or a wall, this is to denote also a large wall portion or roof portion.

It is known to erect a building of one or more storeys from space-bounding sections. With known buildings one or more further sections are arranged on one or more sections. This stacking of sections is often a difficult and time-consuming operation, even if large, costly hoisting cranes are employed. The present construction permits of arranging a room on the sections. Moreover a satisfactory stability of dimensions can be obtained.

Where reference is made herein to boundary faces of the space-bounding sections, this is to denote mathematical boundary planes, which may be the top, the bottom and the sides. With this construction the size of the section with the wall in the transport position is considerably smaller than in the case in which the wall occupies its final position on the section.

The wall may be displaceably arranged on the section. According to an advantageous aspect of the invention the wall is fastened to the section so as to be pivotable.

A particularly advantageous construction is obtained by arranging a roof displaceably on the wall, preferably pivotably. In this case the roof may be a flat.roof or a slanting roof.

According to a further embodiment of the section of the invention, the section comprises a metal supporting structure. This supporting structure is very useful to connect thereto the wall of a further space so that the wall is displaceably connected to the supporting structure.

A strong and advantageous construction can be obtained when according to a further embodiment of the section according to the invention a concrete floor is arranged between metal beams of the supporting structure on the bottom.

An advantageous construction is obtained when a portion of the first-mentioned wall is fastened by means of a hinge to the section and a further portion of this wall is pivotally connected with the first-mentioned portion.

Figure 2:
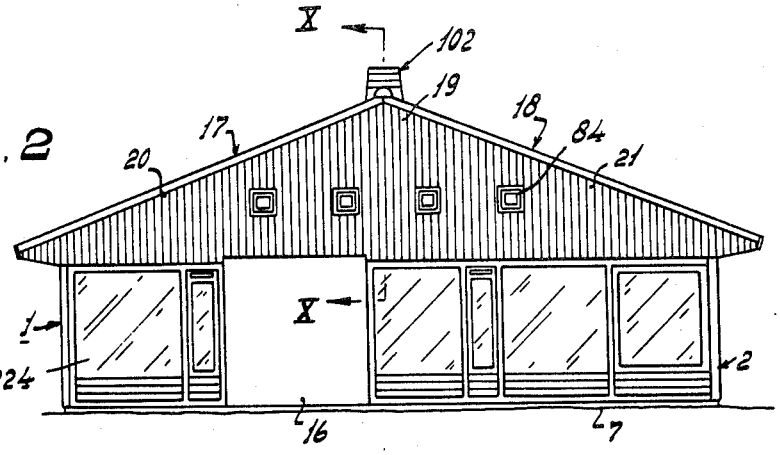
Figure 3:
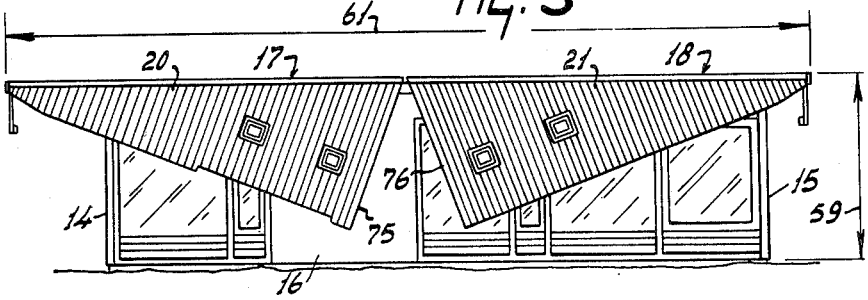
Figure 4:
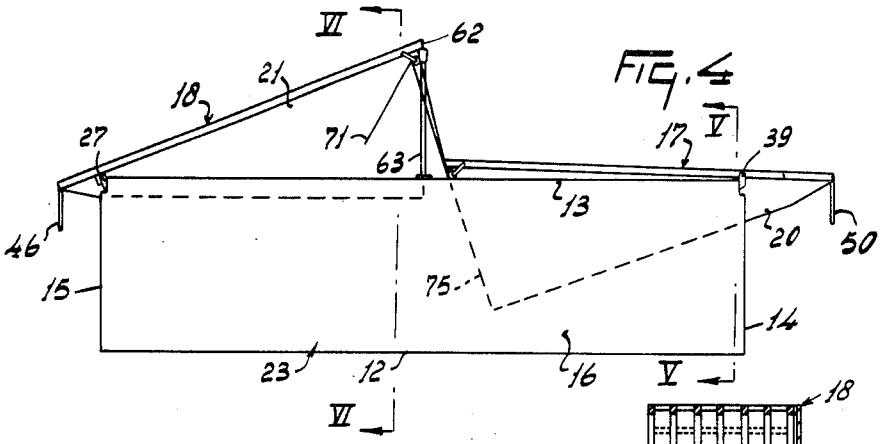
Figure 5:
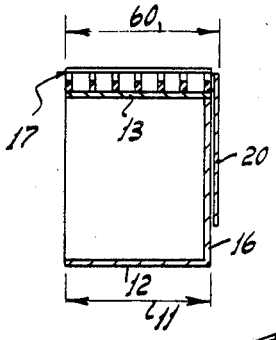
Figure 6:
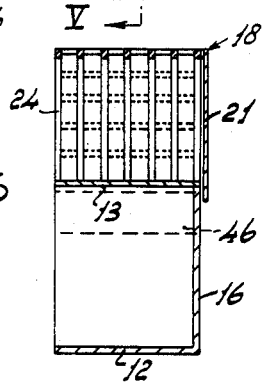
Figure 7:
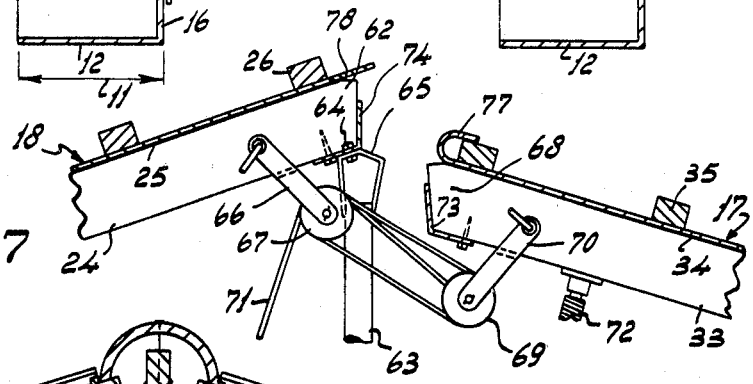
Figure 8:
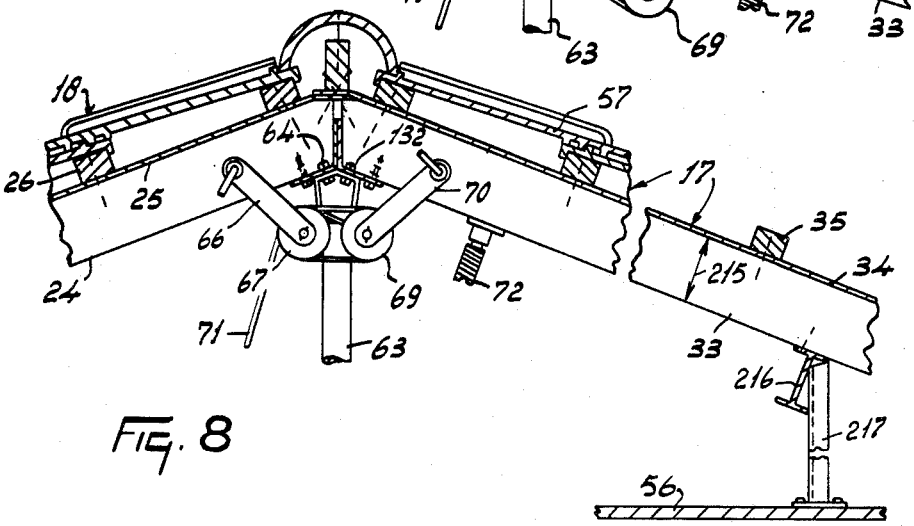
Figure 9:
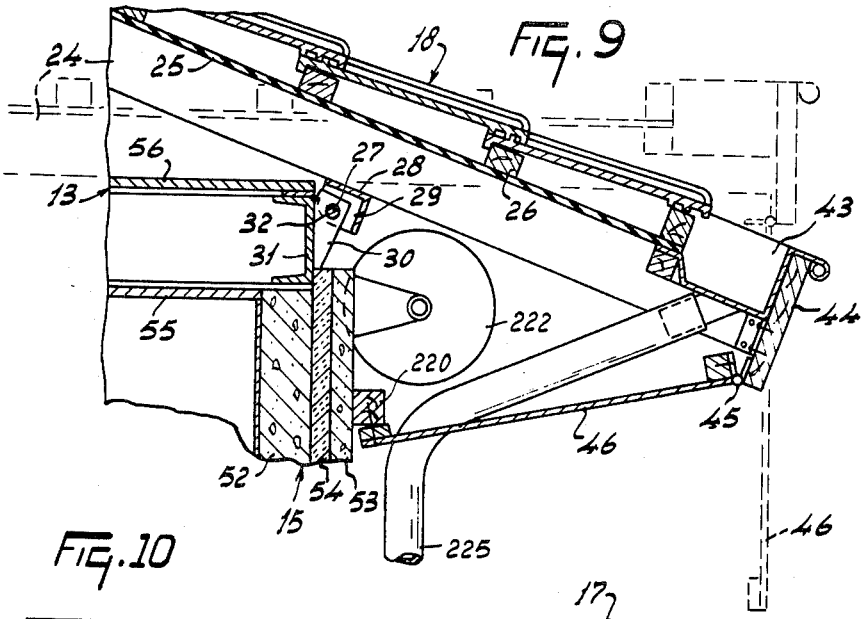
Figure 10:
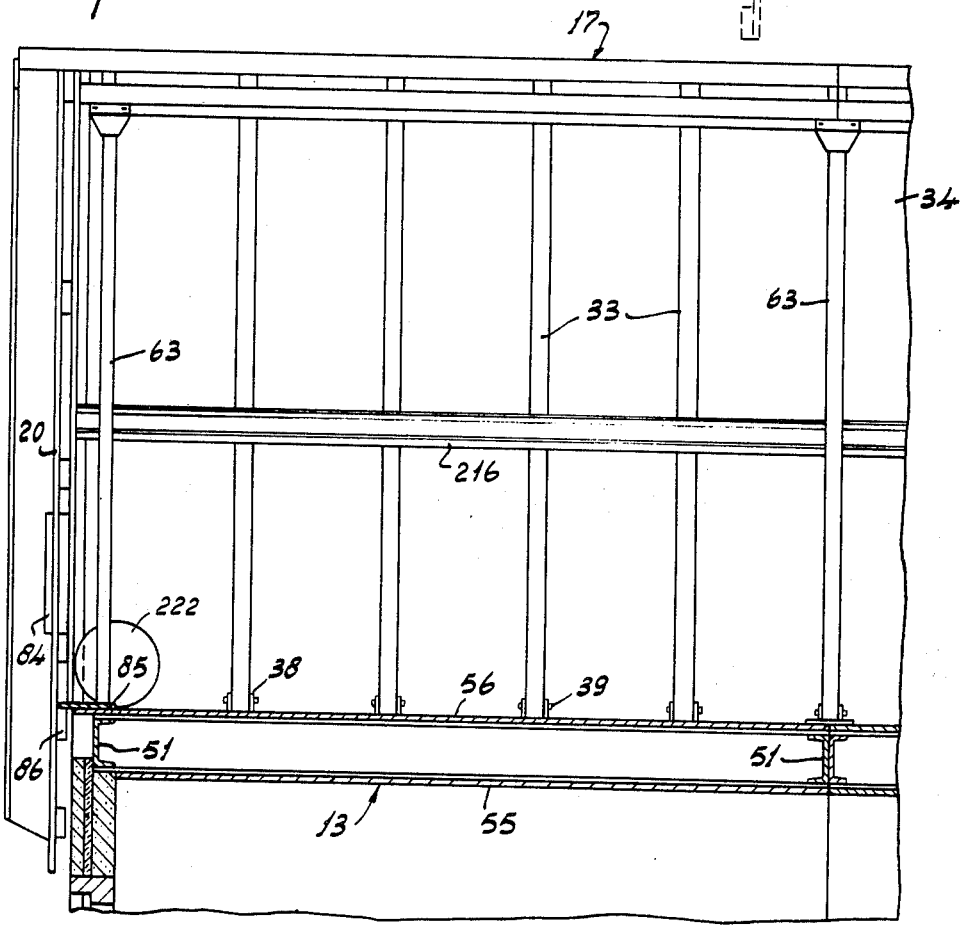
Figure 11:
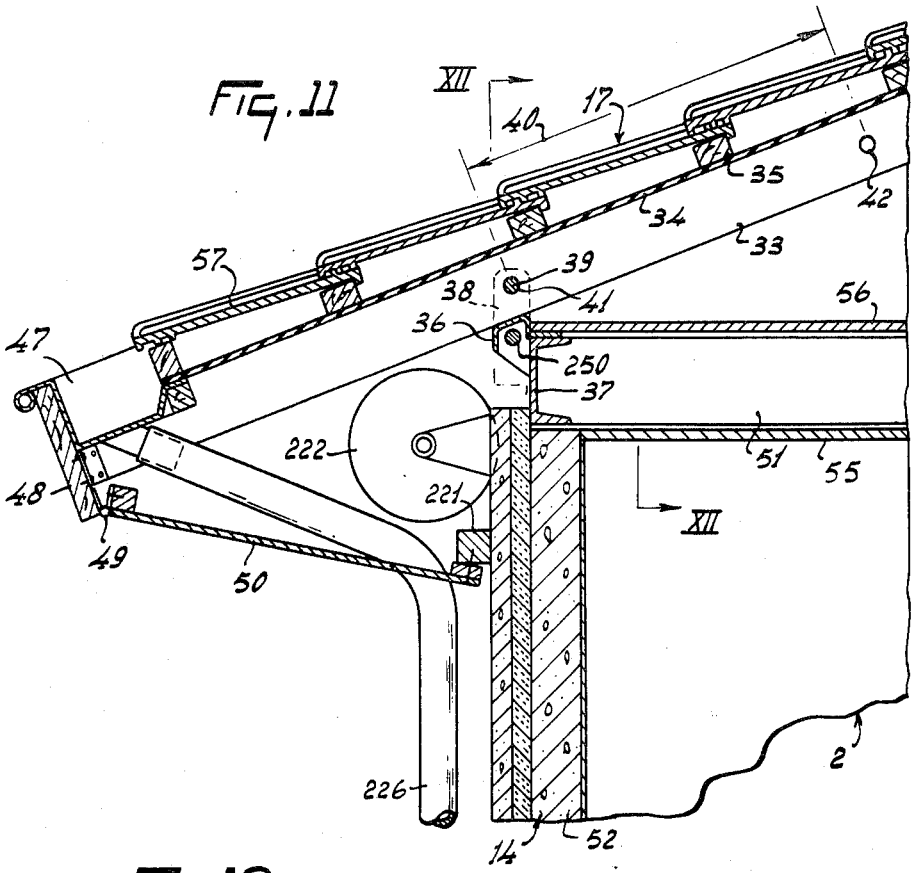
Figure 12:
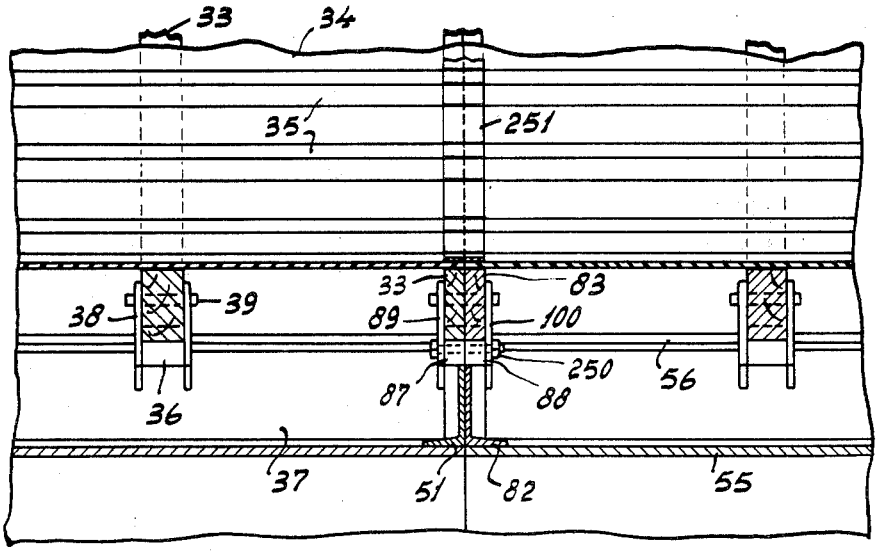
Figure 13:
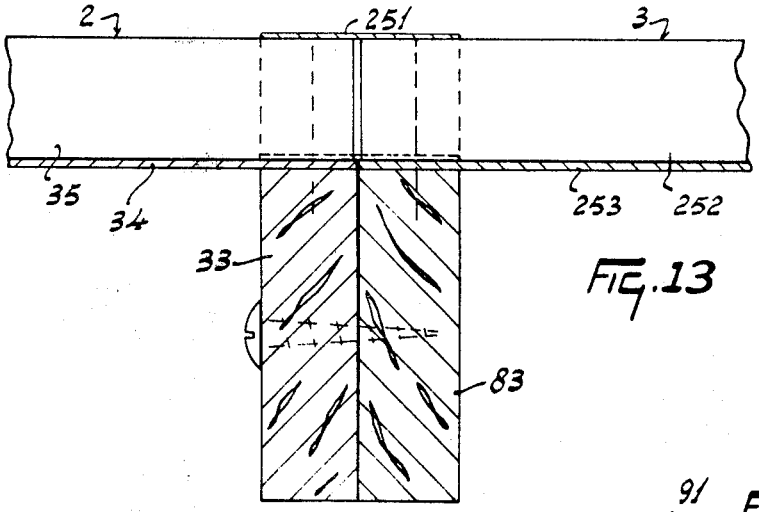
Figure 14:
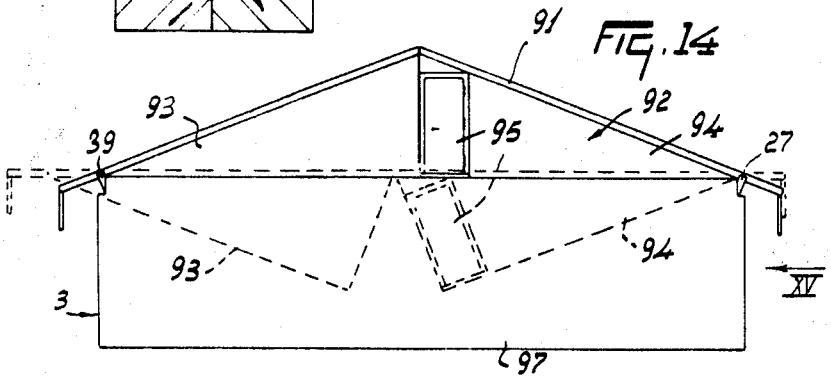
Figure 15:
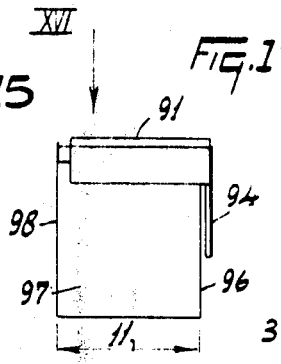
Figure 17:
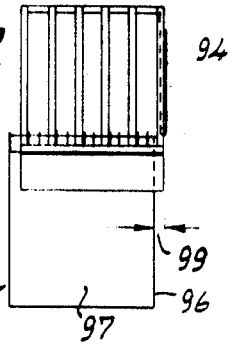
Figure 18:
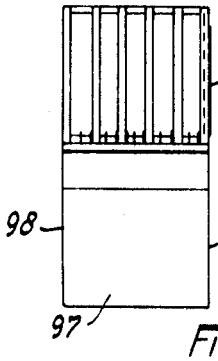
Figure 16:
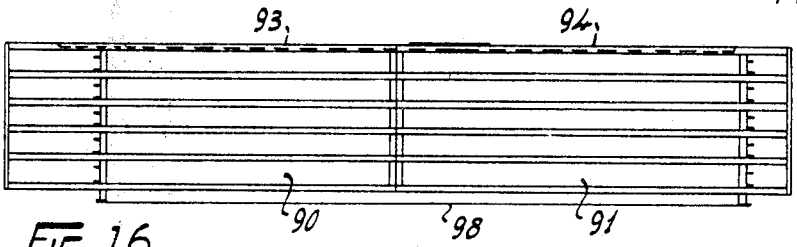
Figure 19:
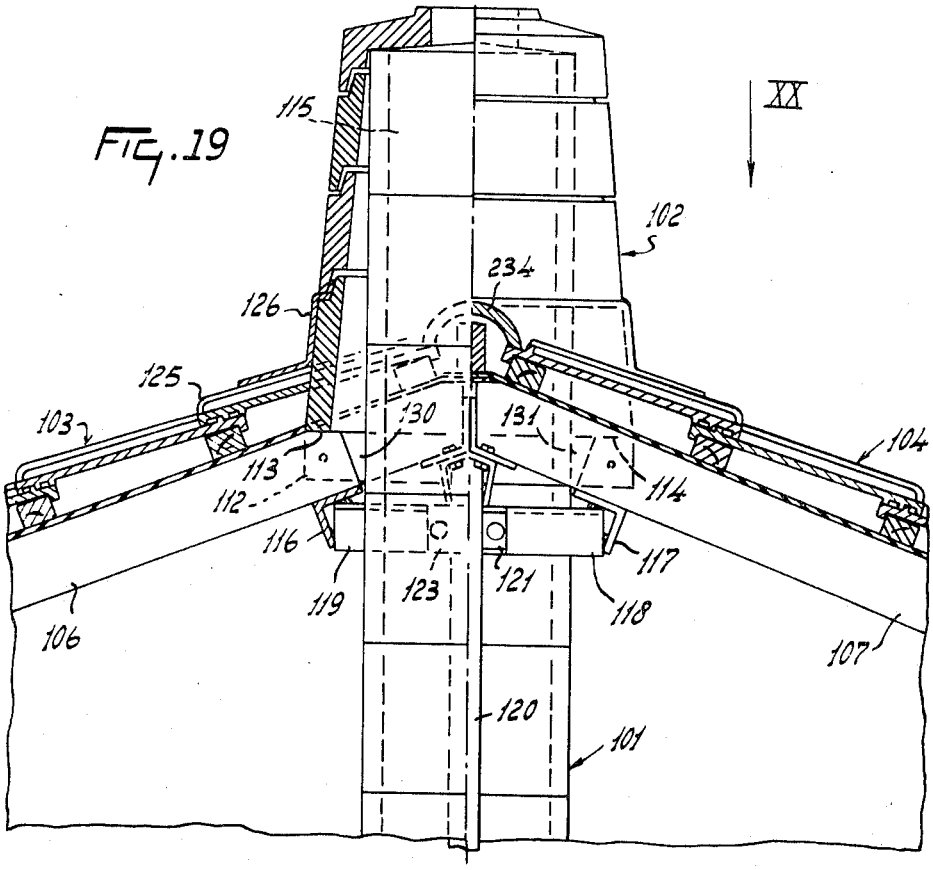
Figure 20:
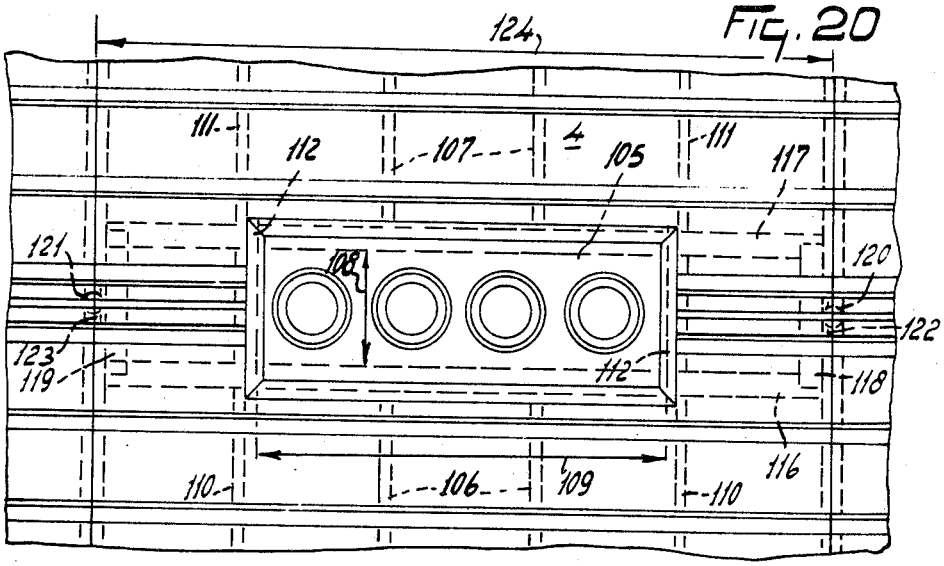
Figure 21:
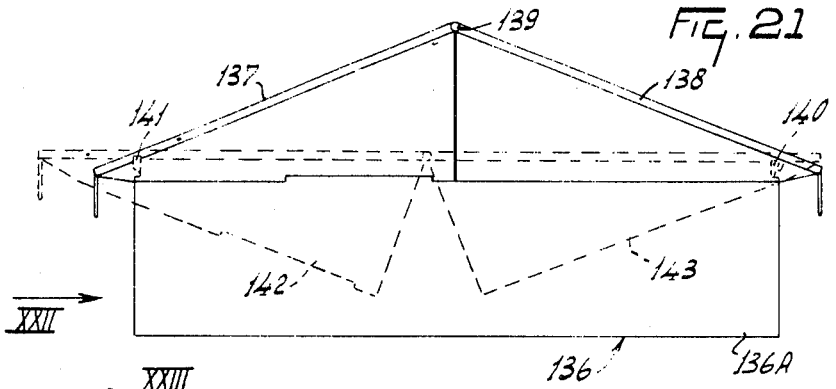
Figure 22:
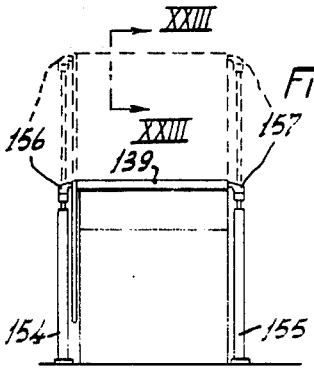
Figure 23:
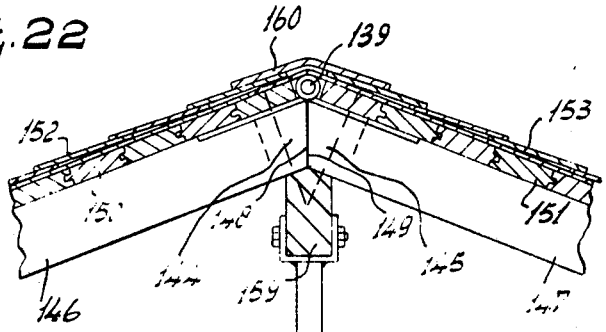
Figure 24:
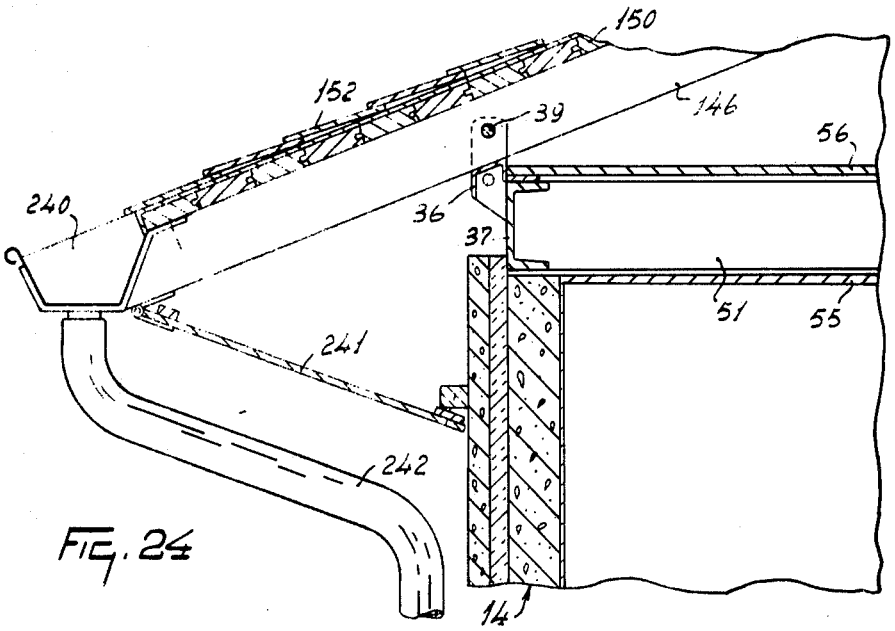
Figure 25:
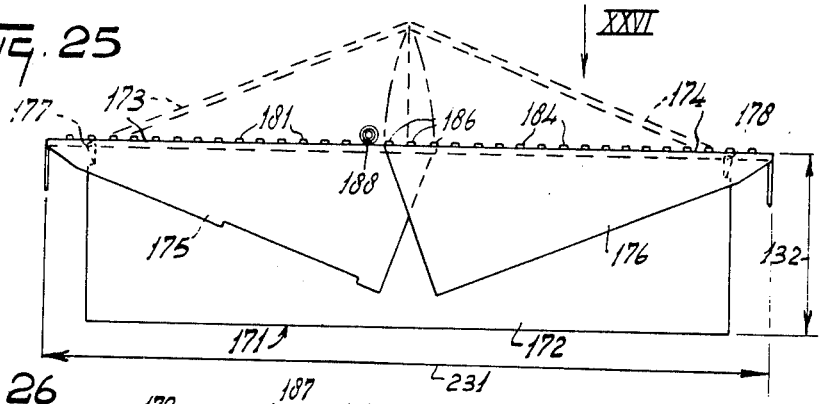
Figure 26:
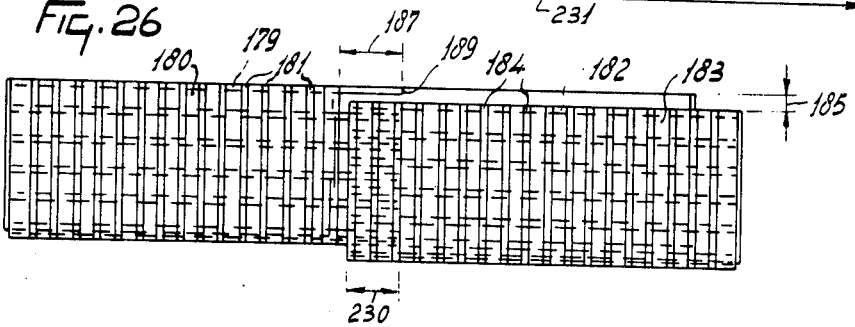
Figure 27:
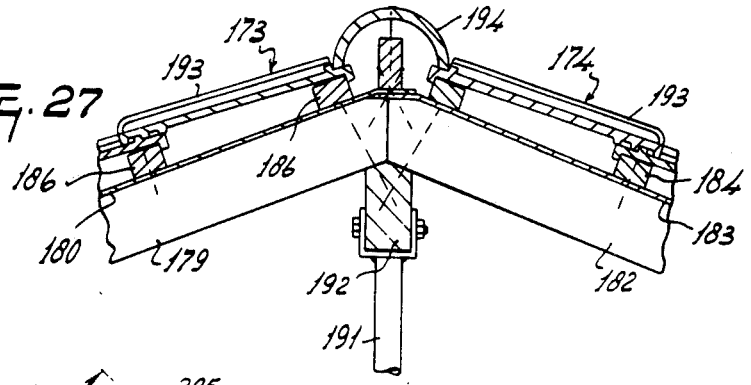
Figure 28:
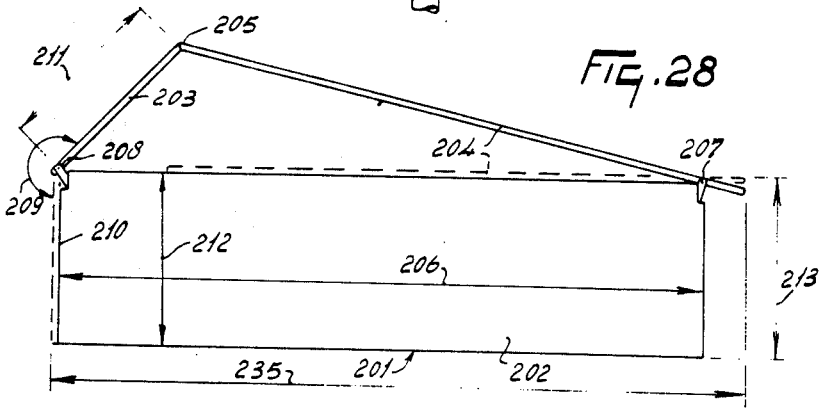
Figure 29:
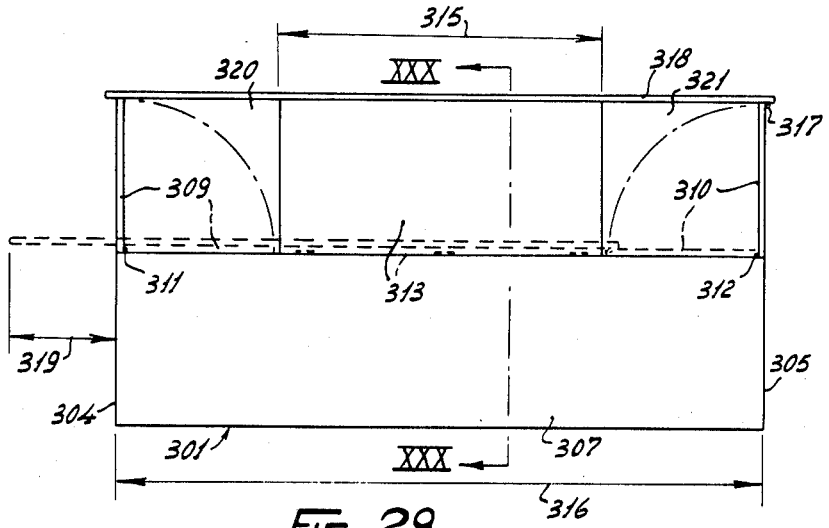
Figure 30:
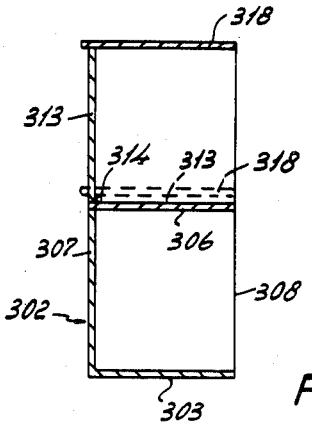
Figure 31:
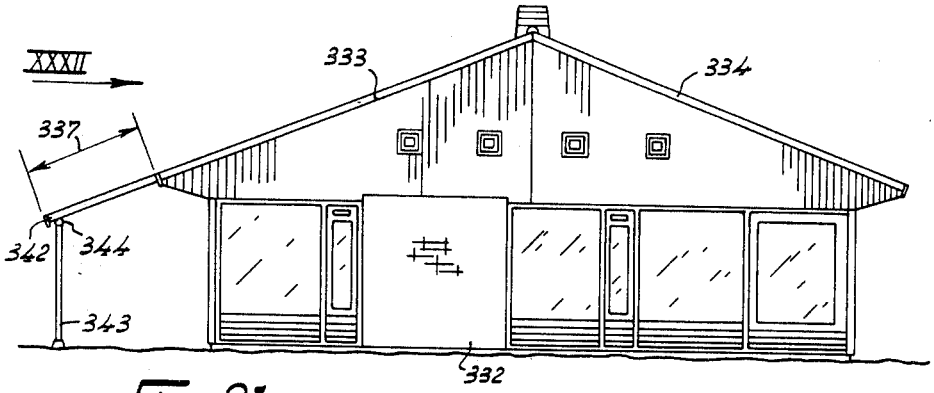
Figure 32:
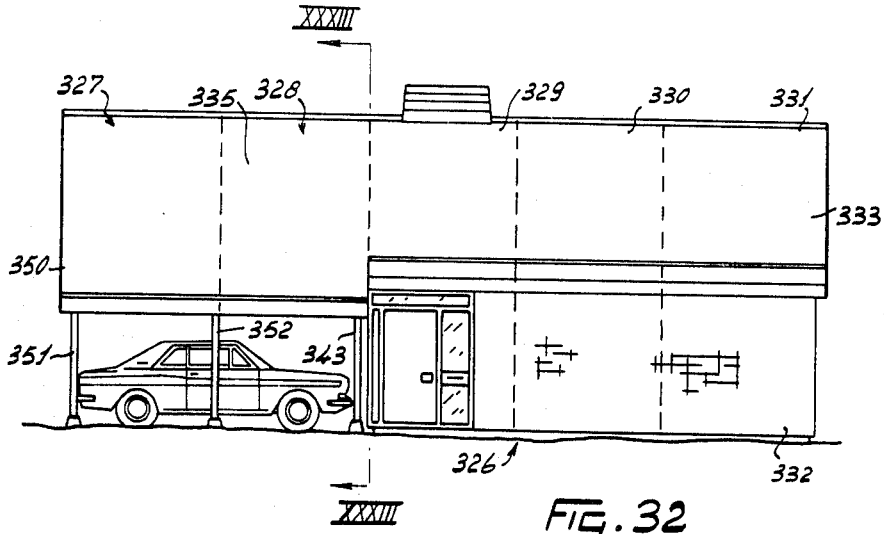
Figure 33:
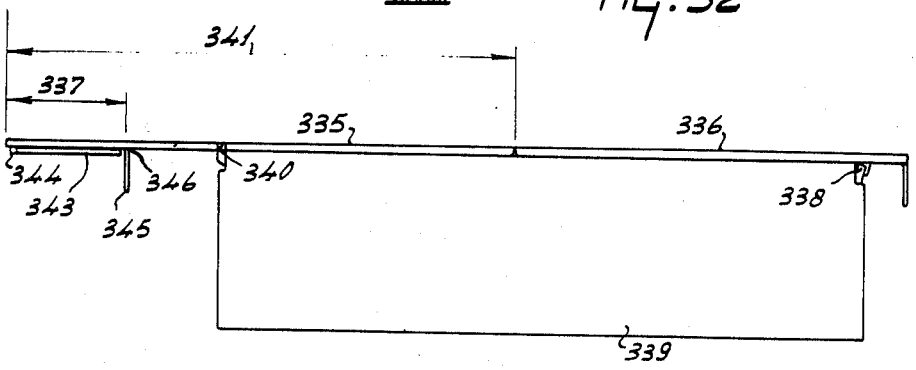
Figure 34:
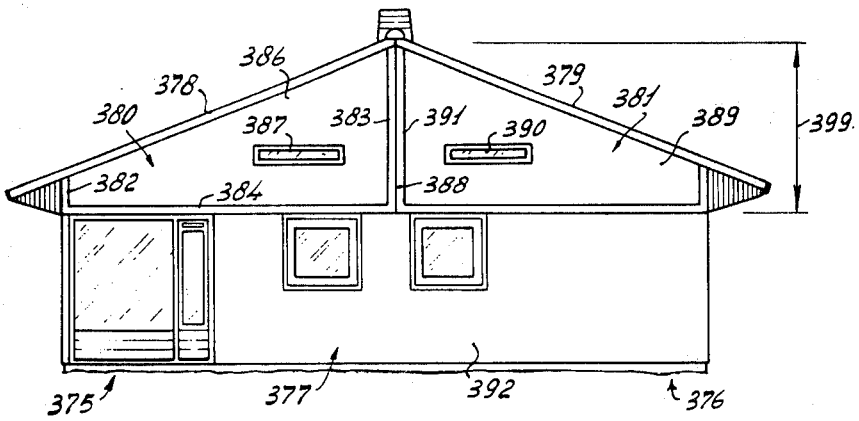
Figure 35:
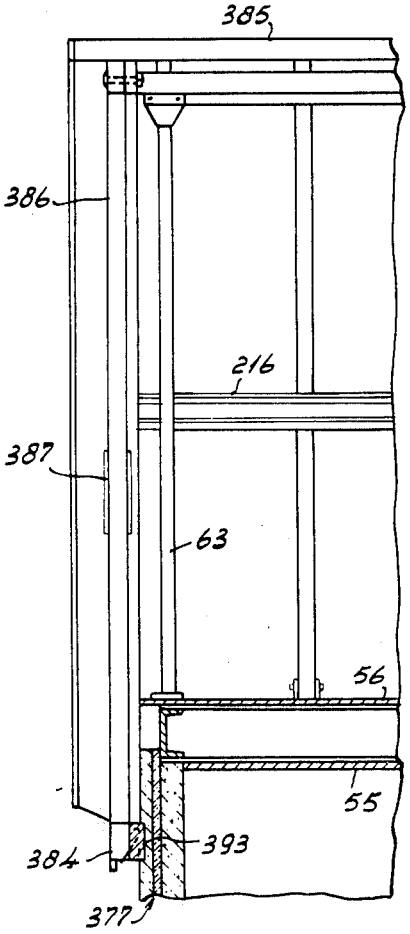
Figure 38:
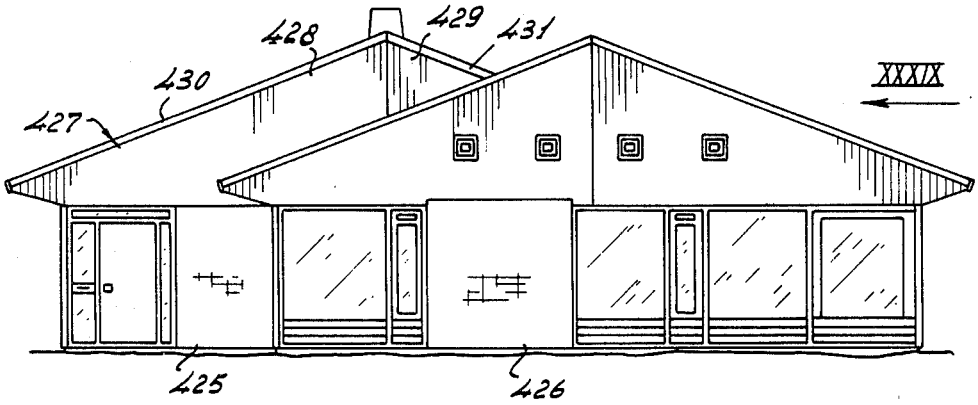
Figure 39:
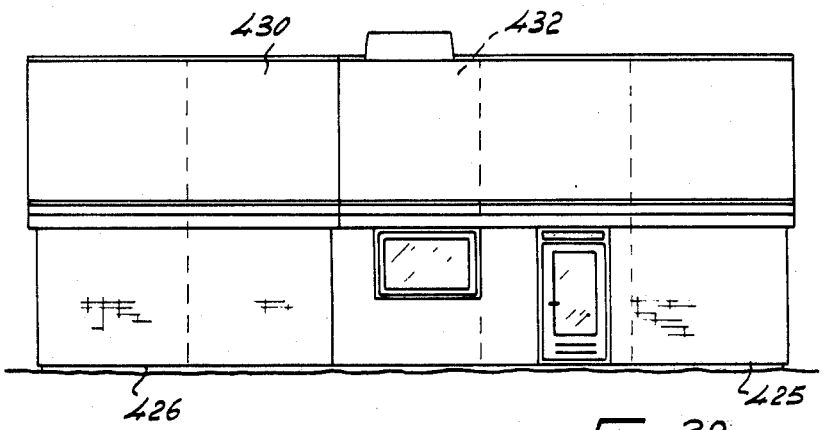
Figure 40:
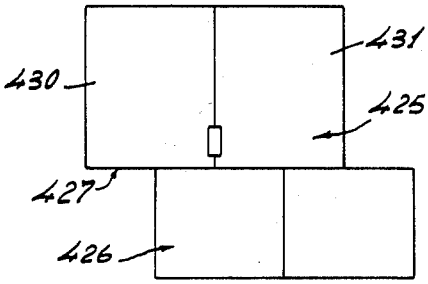
Figure 41:
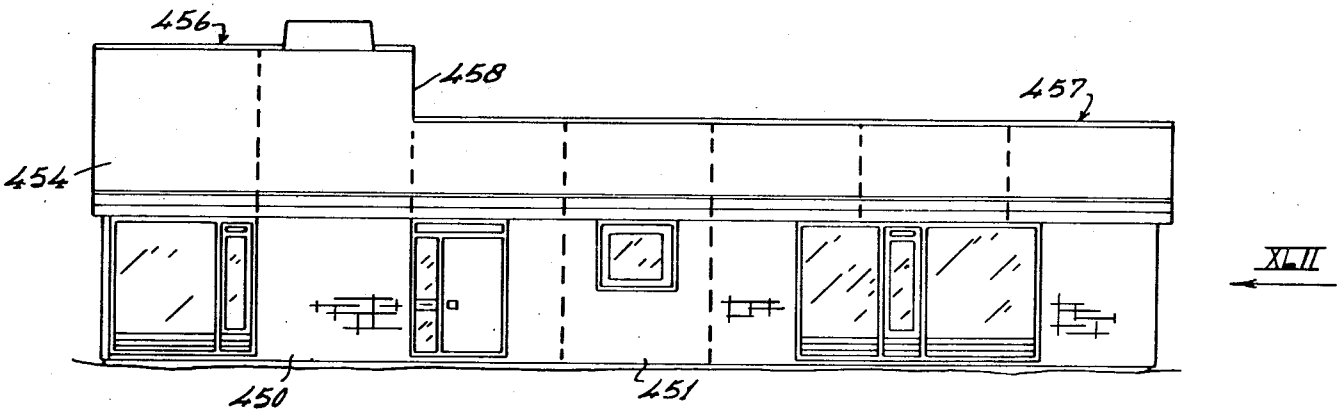
Figure 42:
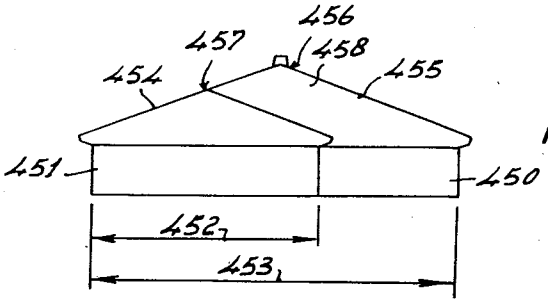

For a better understanding of the invention and to show how the same may be carried into effect, reference will now be made, by way of example, to the accompanying drawings, many of which are schematic and in which:

FIG. 1 is a perspective view of a bungalow formed of prefabricated building sections, FIG. 2 is an elevation of the bungalow taken in the direction of the arrow II in FIG. 1, FIG. 3 is an elevation corresponding with that of FIG. 2, the roof portion and part of the facade wall being shown tilted down, FIG. 4 is a schematic elevation of a prefabricated building section, a roof portion being shown tilted upwards and a further roof portion being shown located on the top face of the section, FIG. 5 is a schematic sectional view of the building section of FIG. 4 taken on the line V—V in FIG. 4, FIG. 6 is a schematic sectional view of the section of FIG. 4 taken on the line VI—VI in FIG. 4, FIG. 7 shows an enlarged scale a detail of the position occupied by the roof portions shown in FIGS. 4 to 6 during mounting operations on the building site, FIG. 8 is an enlarged sectional view of the adjoining edges of the roof portions of FIG. 7 in the mounted state, FIG. 9 is a vertical sectional view of a hinge joint between a roof portion and a building section, FIG. 10 is a vertical sectional view of the top face of a wall portion of a building section taken on the line X—X in FIG. 2, FIG. 11 is a vertical sectional view of a slide-support of a roof portion on a building section, FIG. 12 is a vertical sectional view taken on the line XII—XII in FIG. 11 of the connection between two adjacent building sections, FIG. 13 is a vertical detailed sectional view of the junction of the roof edges of adjacent building sections, FIG. 14 is a schematic elevation of a building section with an elevated roof portion to which a partition is fastened, FIG. 15 is a vertical sectional view of the building section of FIG. 14, a roof portion with a partition secured thereto being shown tilted downward, FIG. 16 is a plan view of the building section of FIG. 14, taken in the position illustrated in FIG. 15, FIG. 17 is a sectional view of the building section of FIG. 14, the roof portion being shown in the elevated position, FIG. 18 is a vertical sectional view corresponding with FIG. 17, the roof portion being shown shifted in position with respect to the living space-bounding part of the building section, FIG. 19 is a vertical sectional view of a chimney of the bungalow and the adjacent edges of the roof portions taken on the line XIX—XIX in FIG. 1, FIG. 20 is a plan view of the part shown in FIG. 19, the roof tiles being omitted, FIG. 21 is a schematic elevation of another form of prefabricated building sections, roof portions being shown hinged to each other, FIG. 22 is a schematic elevation of the section of FIG. 21, taken in the direction of the arrow XXII in FIG. 21, FIG. 23 is an enlarged vertical sectional view of a hinge connection between roof portions taken on the line XXIII—XXIII in FIG. 22, FIG. 24 is a vertical sectional view of a slide-connection of a roof portion with the building section shown in FIG. 21, FIG. 25 is a schematic elevation of a third form in which two roof portions are hinged to the building section, FIG. 26 is a plan view of the form of FIG. 25, the roof portions being shown tilted down and a roof portion being shown shifted in place with respect to the building section, FIG. 27 is a vertical sectional view of joining ridge edges of the roof portions of the form shown in FIGS. 25 and 26, FIG. 28 illustrates schematically a further form of a prefabricated building section having an asymmetrical roof in two portions hinged to the building section, FIG. 29 is an elevation of the long side of a prefabricated building section shown only schematically and having tiltable, vertical walls for an upper storey and a tiltable roof portion, FIG. 30 is an elevation in the direction of the line XXX—XXX in FIG. 29, FIG. 31 is a front view of a further form of a bungalow erected from prefabricated building sections, FIG. 32 is an elevation of the bungalow shown in FIG. 31 taken in the direction of the arrow XXXII in FIG. 31, FIG. 33 illustrates schematically how roof portions of the bungalow shown in FIGS. 31 and 32 can be tilted down for transport purposes, viewed in the line XXXIII—XXXIII in FIG. 32, FIG. 34 is an elevation of the gable of a bungalow erected from prefabricated building sections, FIG. 35 is a vertical sectional view of the upper part of the facade of the bungalow of FIG. 34, FIG. 36 is an elevation of a further form of bungalow erected from prefabricated building sections having tiltable roof portions, FIG. 37 is an elevation of the bungalow of FIG. 36 in the direction of the arrow XXXVII in FIG. 36, FIG. 38 is an elevation of a further form of a bungalow erected from prefabricated building sections and having two relatively displaced portions, FIG. 39 is an elevation in the direction of the arrow XXXIX of FIG. 38, FIG. 40 is a schematic plan view of the bungalow of FIGS. 38 and 39, FIG. 41 is an elevation of a bungalow erected from prefabricated building sections and having two roof parts of different heights, and FIG. 42 is an elevation of the building of FIG. 41 in the direction of the arrow XLII in FIG. 41.

FIGS. 1 to 20 illustrate a bungalow 1 (FIG. 1) having a roof 22. The bungalow 1 is formed from five prefabricated, box-shaped building sections 2, 3, 4, 5 and 6, placed on a foundation 7. The bungalow has a width 8 of about 12 ms and a length 10 of about 12.5 ms. Each building section has a length which corresponds with the length 8 and a width 11 of about 2.50 ms. The length 8 of a building section is preferably not larger than 20 ms and not smaller than 10 ms. The width 11 is preferably between 2.40 ms and 3 ms.

Each of the sections, as is shown for the section 2 in particular in FIGS. 4, 5 and 6, comprises a parallelepiped-shaped portion 23 having a bottom wall 12, a top wall 13 and two end walls 14 and 15. The bottom wall 12 together with the end walls 14 and 15 and the top wall 13 constitute mainly the supporting part of the section. This supporting part preferably consists of a parallelepiped-shaped skeleton of metal beams, supporting material to form a floor, end walls and a ceiling. In accordance with the division of the bungalow into different rooms further walls are arranged between the walls to form inner walls of the bungalow. These inner walls are not shown.

The portion 23 has arranged on it two roof portions 17 and 18, each of which constitutes part of a side of the roof 22 of the bungalow 1. The roof portions 17 and 18 are of equal size so that the ridge 23 of the roof is symmetrical to the width 8. At the front and rear of the bungalow the sections 2 and 6 have facades, for example, the facade 16 of the section 2. This facade 16, as well as the other walls, the floor and the ceiling, is shown only schematically in FIGS. 5 and 6. Above the facade 16, associated with the part 23 of the building section 2, a gable 19 is provided. The gable 19 comprises two portions 20 and 21 (FIG. 3), the portion 20 being rigidly secured to the roof portion 17. The portion 21 is rigidly secured to the roof portion 18.

The floor and the end walls are preferably made of concrete. A portion 55 (FIGS. 9 and 11) of the top wall 13 forms the ceiling just mentioned and a further superimposed portion 56 forms a floor for a space located above the parallelepiped-shaped portion 23 and beneath the roof portions 17 and 18. As is shown in FIG. 6 for the roof portion 17 in detail, each of the roof portions 17 and 18 comprises supporting beams 33 or 24, extending parallel to the longitudinal direction of the section 2 and carrying laths 35 or 26, as illustrated in FIGS. 7, 8 and 9, for tiles 57, as illustrated. The laths also serve as anchorages for rubber-coated asphalt paper 34 or 25, giving a satisfactory anchorage thereof to the supporting beams 33 or 24. It is also possible to mount on the beams 33 or 24 wooden board.

In each of the sections the parallelepiped-shaped portion, for example the portion 23 of the building section 2, constitutes a rigid unit on which the roof portions 17 and 18 are mounted so that these portions can be arranged with their faces that will be asphalt paper and/or tile covered in use flat on the top wall 13 of the portion 23, as is shown in FIG. 3. The roof portions 17 and 18 themselves constitute individual units, which are arranged above the walls 14 and 15 respectively on the top of the portion 23 of the section 2, the portion 18 being movable about a hinge shaft 27. To this end, to the underneath (in erected condition) of the supporting beams 24 of the roof portion 18 is secured an L-section beam 28 (FIG. 9). Plates 29 secured to this L-section beam 28 are located at the side of supports 30 arranged on a channel section beam 31 above the wall 15 and forming part of the skeleton of the parallelepiped-shaped portion 23 of the section 2, there being a plate 29 near each of the supporting beams 24 and the beam 31 being provided with an equal number of supports 30. Each plate 29 and support 30 lying side by side and in contact with each other are secured to each other by a pivot pin 32, the axes of these aligned pins 32 forming the pivotal axis 27 for the roof portion 18.

The roof portion 17 includes, as indicated above supporting beams 33 corresponding to the beams 24 of the portions 18 and extending parallel to the longitudinal direction of the section. The roof portion 18 with the beams 33 bears on a number of support slides 36 (FIG. 11) secured to a metal beam 37 which is above the wall 14 and forms a part of the skeleton of the parallelepiped-shaped portion 23 of the section 2. The support slides 36 are each provided on each side with guides 38 (FIG. 12). Between these guides 38 the associated supporting beams 33 are held laterally. Each pair of guides 38 have registering holes, through which holes, and through holes 41 in the beams 33, pins 39 are passed for locking the roof portion 18 in the erected position shown in FIG. 11. The supporting beams 33 have, at a distance 40 from the holes 41, registering holes 42. Through the holes 42 the pins 39 can be passed when the roof portion 18 is shifted in position along the support slides 36 with respect to the position shown in FIG. 11. The purpose of this alternative position will be described hereinafter.

The roof portion 18 is also provided with a gutter 43 and eaves 44. Hinged to the bottom edge of the eaves 44 (FIG. 9) by a hinge 45 is a cover strip 46 (FIG. 9). From FIG. 11 it will be seen that the roof portion 17 also has a gutter 47, eaves 48 and a cover strip 50 hinged to the eaves by means of a hinge 49.

The sections 2, 3, 4, 5 and 6 are preferably prefabricated completely in a factory and thereafter transported to the building site. On the building site the sections are arranged on the foundation 7 and connected with each other to form the bungalow 1. Prior to prefabrication the parallelepiped-shaped portion 23 is made as a single unit. This unit comprises a skeleton of metal beams, amongst others the beams 30 and 37 shown in FIG. 9 and 11. These beams 30 and 37 are connected with each other by longitudinal beams 51 (FIG. 10) extending in the direction of length of the section and associated with the skeleton. On the base a plurality of horizontal beams are provided and the upper and lower beams of the skeleton are interconnected by vertical beams so that a parallelepiped-shaped skeleton of beams is formed, which is not shown in detail in the drawings. The bottom wall 12, end walls 14 and 15 and top wall 13 are fabricated between the beams of the skeleton. The bottom wall 12 is preferably made of concrete. The walls 14 and 15 have concrete layers 52 and 53, between which an insulating layer 54 is provided (FIG. 9). The top wall 13 includes a ceiling 55 below its beams and a floor 56 above its beams. Although in this form the beam skeleton is provided with a closed bottom wall, closed side walls and a closed top wall, a plurality of these walls may be left open to form larger spaces within adjoined sections. The skeleton thus consitutes, so to say, the space-bounding building section.

Independently of the parallelepiped-shaped portion 23 the roof portions 17 and 18 are completely prefabricated with a large roof edge and cover strip such as the strip 46.

When the portion 23 and the roof portions 17 and 18 are completely prefabricated, the roof portion 18 is secured to the portion 23 in the factory by means of the hinge pins 32. After the portion 18 has been secured to the portion 23 the portion 18 is placed down flat on the floor 56 of the top wall 13 of the portion 23 as is shown in broken lines in FIG. 9. The cover strip 46 remains suspended from the eaves as is shown in broken lines in FIG. 9. To the portion 18 is secured the portion 21 of the gable 19. This connection of the portion 21 is carried out as convenient before the portion 18 is secured to the portion 23 by means of the hinge pins 32 or after the portion 18 is secured to the portion 23. In the position in which the portion 18 is located on the top wall of the portion 23, the portion 21 hangs down alongside the gable 16 as is shown in FIGS. 3 and 5.

The portion 17 is arranged on the portion 23 so that the supporting beams 33 are located on the support slides 36 between the guides 38. The portion 17 is arranged on the portion 23 as is shown in FIG. 3. The holes in the beams 33 are in line with the holes in the guides 38. The pins 39 are inserted into the holes in the guides 38 and the holes 42 so that the portion 17 is rigidly secured to the portion 23. The portion 17 has secured to it the portion 20 so that, when the portion 17 is lying flat on the portion 23, this portion 20 is located at the side of the facade 16, as is shown in FIG. 3.

The portion 23 has a height 58 of about 2.90 ms. When the portions 17 and 18 are lying flat on the portion 23, the over-all height of the portions 17 and 18 with the portion 23 amounts to about 3.10 ms (height 59). This height of only a little more than 3 ms permits of transporting a section that will have a pointed roof when erected from the factory to the building site. The section to be transported in which the gable portions 20 and 21 are located at the side of the facade 16 has a width 60 of about 2.65 ms. The over-all length 61 of the section to be transported in the position shown in FIG. 3 amounts to about 14 ms. When the section arrives at the building site in the positions shown in FIG. 3, the roof portions 17 and 18 are displaced with respect to the portion 23 of the section so that they occupy the position shown in FIGS. 1 and 2. The roof portions 17 and 18 then form the slanting roof surfaces, the proximal ends of which are secured to each other and form part of the ridge of the roof. In order to move the portions 17 and 18 into the position shown in FIGS. 1 and 2 the operation is as follows.

The roof portion 18, which is connected with the portion 23 by means of the hinge pins 32, is elevated by lifting means, for example, a screw jack, into the inclined position shown in FIG. 4. When the roof portion 18 occupies the inclined position relative to the parallelepiped-shaped portion 23, as is shown in FIG. 4, supports 63 are arranged beneath the ridge edge 62 of the roof portion 18. The supports 63 are secured to the top wall above the long side of the portion 23 (FIG. 10), for which purpose means not shown in the drawings are provided on the top wall 13 of the portion 23. When the supports 63 are put in place, the roof portion 18 is secured by means of bolts 64 to the top ends 65 of the supports 63, as is shown in FIG. 7. After the roof portion 18 is arranged in the position shown in FIG. 4, a pulley 67 is fastened near the ridge edge 62 of the roof portion by means of arms 66 to one or more supporting beams 24. On the ridge edge 68 of the portion 17 a pulley 69 is secured by means of arms 70. By means of a rope 71, passed around the pulleys 67 and 69, the roof portion 17 is lifted after the pins 39 have been withdrawn from the holes 42 of the supporting beams 33. When the portion 17 has arrived approximately at its final position, as is shown in FIG. 7, a screw jack 71 is arranged beneath this portion so that over the last part of its movement from the position of FIG. 4 to the position shown in FIG. 8 the portion 17 can be elevated by the screw jack. The portion 17 can then be drawn by the rope 71 onto the top ends 65 of the supports 63 so that the edge 73 of the roof portion 17 comes into contact with the corner piece 74 of the ridge edge 62 of the roof portion 18, as is shown in FIG. 8. In this position the roof portion 17 is fastened by means of bolts 132 to the top ends 65 of the supports 63. In this position of the roof portion 17 the supporting beams 33 will be located between the guides 38 so that the holes 41 in the beams 33 are in line with the holes in the guides 38. The hinge pins 39 are passed through the holes in the guides 38 and the holes 41 in the beam 33 so that the lower side of the roof portion 17 is coupled with the portion 23 near the top of the end wall 14. By moving the roof portions 17 and 18 into the position shown in FIGS. 1, 2 and 8 the gable portions 20 and 21 move along the facade 16 into the position shown in FIGS. 1 and 2, and the edges 75 and 76 of the gable portions come into contact with each other so that an uninterrupted front is formed. The joining edges 75 and 76 can be covered by a cover plate not shown in detail in the Figures. The lower edges of the portions 20 and 21 are secured by means of a strip 85 to the floor 56. The strip 85 is secured to a beam 86 of the portions 20 and 21 and the floor 56 after the roof portions 17 and 18 are arranged in place as is shown in FIGS. 2 and 8. In this embodiment the gable is formed by profiled sheets, but it may consist of different material. The ridge edges 62 and 68 of the roof portions 17 and 18 are covered by an overlapping strip 77 which is part of the roofing 34 of the roof portion 17. This overlapping strip 77 is arranged across the edge portion 78 of the roofing 25 of the roof portion 18 as is shown in FIG. 8 so that the edge portion 78 is then lying on the top of the ridge 68 of the roof portion 17 and the overlapping part 77 is lying across the ridge 62 of the roof portion 18. The overlapping strip 77 can be stuck to the edge portion 78.

Thus, a prefabricated building section is provided in a simple manner with a roof portion so that transport of the section is possible with a smaller height than the over-all erected height 79. The roof portions 17 and 18 can be put up in the inclined position shown in FIGS. 1 and 2 before the section is shifted in the building being erected into its place adjacent the neighbouring section or sections. By arranging the roof portions 17 and 18 in their inclined positions relative to each other before joining the section concerned to the neighbouring section(s) of the building more space is available for lifting the roof portions out of the position shown in FIG. 3. When the sections are placed in contact with each other they can be coupled with each other, for example, by interconnecting adjacent metal beams e.g. 51 and 82 of FIGS. 10 and 12 by means of bolts. In the contacting positions of, for example, the sections 2 and 3, the supporting beams of the roof portions of the sections concerned are in contact with each other, which is illustrated in FIG. 12 for a beam 33 and the supporting beams 83 of the section 3. These supporting beams 33 and 83 can be bolted to each other at one or more further spots so that the roof portions and the parallelepiped-shaped portions of adjacent sections are rigidly connected with each other. The adjacent support slides of neighbouring sections can be constructed in conjunction as is shown in FIG. 12. The support slides 87 and 88 of these sections are located in contact with each other in the mounted state of the sections and have each only a guide 89 and 100 respectively, between which two neighbouring beams 33 and 83 are located. Between these guides the beams 33 and 83 can be clamped together by means of a bolt, for example, the bolt 250 in FIGS. 11 and 12, when the adjacent support slides are arranged in place.

The adjacent edges of the roof portions of adjacent sections are covered by a cover strip 251 (FIG. 13). This strip is arranged on the rubber-coated roofing material 34 (or 25) of the building section 2 and the corresponding roofing material 253 of the building section 3. The strip 251 is arranged across the adjacent laths 35 of the building section 2 and the corresponding laths 253 of the building section 3. The strip 251 is secured to the edges of the roof portions of the building sections by means of an adhesive and/or by other means.

After the roof portions, e.g. the portions 17 and 18 are set in their final, erected positions, the hinged cover strips 46 (FIG. 9) and 50 (FIG. 11) are turned about their hinges and fastened to beams 220 and 221 respectively of the walls 15 and 14 respectively. The space above a cover strip, e.g. the covering strip 46 may be effectively employed for storage of a Venetian blind 222 for a window of the facade formed by the wall 15. For a window in the facade 16 below the gable 19 a Venetian blind 223 (FIG. 10) may be arranged above the floor 56 behind the gable 19. From this position the blind can be guided downwards through an opening left free above a window, for example, the window 224, when the strip 85 is fastened in position. Rain water conduits 225 and 226 can be passed through openings in the strips 46 and 50. These conduits may, if desired, be placed during the prefabrication of the portion 23. After the sections with the roof portions are mounted in their final positions in the building, the conduits 225 and 226 can be connected with the gutters 43 and 47 respectively.

Above the floors 56 and beneath the roof portions of the associated sections, for example, the roof portions 17 and 18, a loft space is defined, which may be employed for storing goods not to be used daily, for instance, trunks and the like. This space may, however, also be utilised for bedrooms and/or hobby rooms. For this purpose the loft spaces may be bounded by boards secured to the lower faces of the supporting beams 24 and 33, which is not shown in the drawings. The loft extending below the whole roof of the building may be divided by partitions. The roof and/or the gable, for example the gable 19 and the portions 17 and 18 may have windows for lighting the loft, for example, the windows 84 in the gable 19 (FIG. 2).

A partition in the loft may extend over the whole width of the building beneath the roof portions of a section, for example, the section 3. FIGS. 14 to 18 show, schematically, an embodiment in which such a partition 92 is provided. The partition 92 is shown in FIG. 14 in an elevation. In the erected building this partition is located above the long side of a section, for example, the side 96 (FIG. 15). The partition 92 shown in FIG. 14 comprises two portions 93 and 94, each of which is secured to a roof portion 90 and 91 respectively. The roof portions 90 and 91 and their connection with the parallelepiped-shaped portion 97 of the section 3 correspond with the roof portions 17 and 18. The portion 94 of the partition 92 has a door 95. The portions 93 and 94 are secured to the roof portions 90 and 91 in the same manner as has been described for the gable portions 20 and 21 and the roof portions 17 and 18. The ridge portions 21 and 20 are located in the mounted position of the section shown in FIG. 6 at the side of the facade wall 16. Simply by lifting the roof portions 17 and 18 from the position shown in FIG. 3 the ridge portion gets into the position which it has to occupy in the building, when the section is mounted. With the sections located between the end sections 2 and 6 the sides of the roof portions e.g. the roof portions 90 and 91 of the section have to be located, in the mounted state, just above the sides 96 and 98 of the parallelepiped-shaped portion of the section because the roof portions of adjacent sections in this embodiment join each other satisfactorily. In order to enable, for the transport position, an arrangement of the portions 93 and 94 of the partition 92 along the long sides, for example, the sides 96 of FIG. 15, the roof portions 90 and 91 of this embodiment with the partition parts secured thereto are slidable over a short distance in the direction of width of the section. In the transport position shown in FIG. 15 for the building section 3 the roof portion 91 is shifted with respect to the parallelepiped-shaped portion 97 over a distance 99 in the direction of width 11 of the section 97. The portion 94 can be arranged at the side of the wall 96 for transport purposes. The portion 93 is arranged along the side 96 for transporting the building section. The portions 93 and 94 of the partition 92 are thus located in the same manner along the side 96 as is shown in FIG. 3 for the gable portions 20 and 21 located along the side 16.

When the section 3 has arrived at the building site, the roof portions 90 and 91 can be elevated in the same manner as the roof portions 17 and 18. After elevation and arrangement in the correct inclined position of the roof portions 90 and 91, the portions 93 and 94 of the partition 92 are still at the side of the wall 96, as is shown in FIG. 1. It will be obvious that when the roof portions are lifted, the wall portions such as the partition 92 and/or the gable 19 are lifted. These wall portions are, consequently, also hinged to the building section via the roof portions. The connection and construction of the hinge pins and the slide supports of FIGS. 14 to 18, corresponding with the connection of the roof portions 17 and 18 of the section 2, are such that the roof portions 90 and 91 can be displaced over a distance 99 with respect to the portion 97. After the roof portions 90 and 91 have been lifted, they are displaced over the distance 99 so that they occupy the position shown in FIG. 18. The roof portions 90 and 91 are locked in this position against displacement along the hinge pin or along the support slides. The portions 93 and 94 of the partition 92 are thus located in their final positions inside the place of the sides 96 of the parallelepiped-shaped portion 97 of the building section 3. In the position shown in FIG. 18 the sides of the roof portions 90 and 91 are flush with the sides of the parallelpiped-shaped portion 97 so that the section 3 can join as a whole, satisfactorily, the sections 2 and 4. Tiles, for example as at 57 in FIG. 11, may be disposed on the laths of the roof portions 90 and 91, either during prefabrication or after the sections are mounted in their final positions in the building on the building site.

Adjacent sections can be secured to each other from the loft as the supporting beams are readily accessible from the loft. The bolts of the beams, for example, the beams 51 and 82 (FIG. 12) can be put in through openings in the floor 56. These openings can be provided with coverable apertures. For putting these bolts in place the ceiling need not be opened then.

It will be appreciated that the living space of the bungalow formed principally by the parallelepiped-shaped portions of the sections 2 to 6 is expanded by an upper space obtained on the building site by elevating the roof portions arranged during the prefabrication on the parallelepiped-shaped, box-shaped portions, for example, the portion 23 of the section 2. THe roof constitutes a satisfactory insulation for the living space beneath the roof. The roof is aesthetically attractive, it requires little maintenance and conducts rain water readily to the sides of the building. Since the roof portions 17 and 18 can be elevated independently of each other, this operation can be readily carried out, since the weight to be lifted at one time is not excessively heavy. The roof portions may, if necessary, be lifted by manual force. Together with the supports 63 the roof portion 18 constitutes a strong triangular support for hoisting the roof portion 17. The position of the supporting beams 33 between the guides 38 and the connection of the supporting beams 24 to the hinge pins 32 provide a satisfactory anchorage of roof portions against lateral displacement on the box-shaped sections such as the portions 23, when the whole building section, for example, the section 2, is transported. The construction is particularly suitable for series prefabrication in factories. If desired, these factories may be displaceable for carrying out the production near the building site. By using a plurality of adjacent supporting beams in a roof portion the thickness of the roof structure inclusive of the supporting beams may be comparatively small. This is advantageous for providing a suitable height of the living spaces in the building sections, for example, in the portion 23, for instance a height of 2.60 ms without the risk of having an excessive transport height 59. The height 215 (FIG. 8) of the supporting beams may be particularly small, when approximately midway between the lower end near the pivotal axis 27 of the roof portion 17 respectively 18 and the top ends 62 and 68 of the supporting beams a further support, for example, a beam 216 is arranged, which is held preferably by two upright supporting beams, for example the beam 217, on the top of the portion 23. The beams 217 are preferably held on longitudinal beams in the long sides of the top wall 13 of the section portion 23, for example, the beams 51 (FIG. 10) of the embodiment described.

FIGS. 19 and 20 show the construction of the connection of the roof portions 103 and 104 of the building section 4 with the chimney 101. The connection of the roof portions 103 and 104 with the box-shaped portion 130 of the building section 4 is identical with the structure shown for the building section 2. The joining sides of the roof portions 103 and 104 have recesses 130 and 131 respectively forming an opening 105 for the jacket 102 of the chimney 101. The chimney jacket 102 is held in this opening 105. In order to form the opening 105 the supporting beams 106 and 107 of the roof portions 103 and 104, these beams corresponding with the supporting beams 33 and 24 of the roof portions 17 and 18, are shorter than the beams 33 and 34. The opening 105 has a width 108. The roof covering provided on the supporting beams 106 and 107 is also omitted over the width 108 to leave the opening 105 free. The opening has a length 109 corresponding approximately to three times the distance between adjacent supporting beams of the roof portions concerned. The short sides of the opening 105 extend along contacting supporting beams 110 and 11 of the roof portions 103 and 104 respectively. Clamps 112 are fastened to these contacting beams. The chimney jacket 102 is arranged on the clamps 112 and the ends 113 of the shorter supporting beams 106 and 107, the jacket fitting around the top end 115 of the chimney 101, for supporting the roof portions 103 and 104 at the top a framework is provided which comprises two longitudinal beams 116 and 117 connected adjustably by two short beams 118 and 119. This framework is fastened to supports 120 and 121 on which the tops of the roof portions 103 and 104 bear. The supports 120 and 121 are located in the long sides of the building section 4, secured to the tops of the section portion 130. The beams 118 and 119 of the framework are secured to cover plates 122 and 123 (FIG. 20) arranged on the supports 120 and 121 respectively. The long beams 116 and 117 form supports for the ends of the shorter beams 106 and 107 and the further supporting beams throughout the width 124 of the building section 4. The part of the chimney jacket 102 joining the tile roofing 125 is covered by a lead strip 126. The supporting framework of the beams 116 to 118 can be arranged in place after the roof portions 103 and 104 have been set in their positions shown in FIG. 19. In this way the roof portions 103 and 104 can lie directly by their supporting beams on the top of the section portion 130 for transport purposes. The height of the assembly to be transported can thus be minimized, whilst the supporting beams bear substantially throughout their length on the top of the portion 130. As an alternative, the beams 116 and 117 may be arranged beforehand on the supporting beams of the roof portions 103 and 104. In this case half of the beams 118 and 119 may be arranged on each of the roof portions. The prefabrication of the building section can thus be furthered so that less labour is required on the building site. The ends of the half beams 118 and 119 remote from the beams 116 and 117 are then fastened to the supports 120 and 121 respectively. The chimney 101 with the jacket 102 arranged on it is erected on the building site from the top 13 of the section portion 23. Preferably the chimney 101 and the jacket 102 are erected of a plurality of portions, whereby the higher ones are fitted on the lower ones. The upper portion of the jacket 102 is provided with a horizontal hood part extending over a part of the chimney. The part of the chimney located inside the portion 23 is arranged therein during the prefabrication.

FIGS. 21 to 24 show a further embodiment, which is shown in FIGS. 21 and 22 only schematically. Herein the roof portions 137 and 138 of a building section 136 are linked to each other by means of a hinge 139. The roof portion 138 is fastened by means of a hinge shaft 140 to the parallelepiped-shaped portion 136A of the section 136. This hinge shaft 140 corresponds with the hinge comprising the pivotal axis 27 formed by the pins 32 described above so that the hinge shaft 140 need not be described in detail. The roof portion 137 is arranged on support slides 141 in the same manner as is described for the roof portion 17 and the support slides 36. In this embodiment further description is therefore not necessary and corresponding parts are designated in FIG. 24 by the same reference numerals as in FIG. 11. The roof portions 137 and 138 can be compared with the roof portions 17 and 18 and the roof portions 137 and 138 are provided with gable portions 142 and 143 respectively corresponding with the gable portions 20 and 21 respectively. The top ends 144 and 145 of supporting 146 and 147 of the roof portions 137 and 138 are shaped in a form such that in the final position occupied in the building as shown in FIG. 23 they join each other at their edges 148 and 149 respectively. The hinge 139 is enclosed between the roofing material arranged on the supporting beams 146 and 147 and consisting of wooden boards 150 and 151 respectively on which slates 152 and 153 respectively are arranged.

For transport purposes the roof portions 137 and 138 of the building section 136 can be arranged in line with each other, as is shown in FIG. 21 by broken lines, on the top of the portion 136A which constitutes the space-bounding part of the building section 136. The roof portion 138 is rigidly secured by the hinge shaft 140 to the portion 136A, whereas the portion 137 is fastened to the support slides 141 in the same manner as is shown for the roof portion 17 in FIG. 11 and the holes 42 in the supporting beams 33. The roof portions 137 and 138 are thus completely locked with respect to the part 136A so that the section can be transported in a simple manner. After the arrival at the building site the roof portions 137 and 138 can be moved into the positions shown in FIG. 21 by solid lines. For this purpose the pin 39 by which the roof portion 137 is locked in place on the support slides 141 is released. Beneath the ends of the hinge 139, on either side of the section, lifting mechanisms 154 and 155, such as, for example, jacks, (FIG. 22) are arranged, which are provided with extensions 156 and 157 which can be arranged beneath the outermost supporting beams 146 and 147 respectively. After the roof is lifted into the position indicated by solid lines in FIG. 21 and in FIG. 22 by broken lines, the roof portion 137 can be locked in place on the support slides 141 by inserting pins 39 as shown in FIG. 11 into holes 41 of the beams 33. Then supports 158 can be arranged beneath the adjoining parts of the roof portions 137 and 138 as is shown in FIG. 23. These supports can be rigidly secured to the parallelepiped-shaped portion 136A, whilst a beam 159, which extends over the whole width of the erection, can be fastened to the ends 144 and 145 of the supporting beams 146 and 147 by means of nails and/or screws (not shown).

If desired, the construction of the roof may be such that the ends 144 and 145 and rigidly secured to each other after the roof portions 137 and 138 are arranged in place as is shown in FIG. 23. With sufficient strength of the pins 32 and 39 the supports 158 may be omitted. This is also possible in the first described embodiment, if the supports 63 are not desired.

When the roof portions 137 and 138 are in the mounted position, a covering strip 160 is put down on the joining edges of these roof portions so that the joint between the roof portions is sealed. The covering strip may consist of suitable material which can be stuck to the roofing material by an adhesive or secured thereto in a different manner.

In this embodiment (see FIG. 24) the roof portion is provided with a gutter 240 and a covering strip 241. The strip is hingeable connected to the beams 146. The rain water conduit 252 is located beneath the strip 241 and connected with the bottom of the gutter 240.

FIGS. 25 to 27 show an embodiment of a building section 171 which is comparable with the section 2 of FIG. 1. In this embodiment the building section 171 comprises a parallelepiped-shaped portion 172, on which roof portions 173 and 174 are arranged. The roof portions 173 and 174 are connected by means of hinges 177 and 178 respectively to the parallelepiped-shaped portion 172. the hinge 177 corresponds completely with the hinge formed by the pivotal axis 27 of the pins 32 shown in FIG. 9. The hinge 178 has the same construction as the unit of the pivotal axis 27 and the pins 32 of FIG. 9. The hinge 178 is constructed so that the roof portion 174 is allowed to shift in place over a distance 185 with respect to the parallelepiped-shaped portion 172. The roof portion 173 has supporting beams 179 on which rubber-coated roofing material 180 and laths 181 are arranged. The roof portion 174 has similar supporting beams 183 with a layer of rubber-coated roofing 183 and laths 184. The roof portions are thus of the same construction, in principle, as the roof portions 17 and 18. FIGS. 25 and 26 do not show the tiles 193 (FIG. 27) to be arranged on the roof portions. The box-shaped portion 172 is completely prefabricated as well as the roof portions 173 and 174. After the prefabrication of the parts concerned the roof portion 173 is fastened by means of the hinge 177 to the portion 172. The roof portion 174 is fastened by means of the hinge 178 to the portion 172. For transporting the section 171 the roof portion 173 is turned about the hinge 177 into the position shown by solid lines in FIG. 25. During the prefabrication the roofing material 180 of the roof portion 173 is left loose over a distance 187 and wound against a lath as shown at 188. Three laths 186 required between the end 189 of the roof portion and the lath at 188 are not fastened to the roof portion 173 during the prefabrication thereof. When the roof portion 174 is fastened flat to the portion 172, the portion 174 is shifted by the hinge 178 over the distance 185 so that it occupies the position shown in FIG. 26. Then the supporting beams 182 can be arranged between the supporting beams 179 of the portion 173. The rubber-coated roofing material 183 then lies above the ends of the supporting beams 179, where the roofing material is not fastened over the distance 187 and the three laths 186 are omitted. The laths 184 can also lie at the ends of the supporting beams 179. The gable portion 175 arranged on the roof portion 173 and corresponding with the portion 20 is located at the side of the section portion 172 in the transport position as is shown in FIG. 25. By shifting the roof portion 174 over the distance 185 with respect to the portion 172 the gable portion 176 can also be located at the side of the portion 172 so that it overlaps part of the gable portion 175 as is shown in FIGS. 25 and 26. After the building section 171 is conveyed in the transport position shown in solid lines in FIG. 25 to the building site, the roof portion 174 can be lifted by the means shown in FIG. 22 corresponding with those of FIGS. 7 and 8. After the roof portion 174 is lifted, the roof portion 173 can also be screwed upward so that these roof portions occupy the positions shown by broken lines in FIG. 25 and partly in FIG. 27. Then supports 191 having a supporting beam 192 can be arranged beneath the joined edges of the roof portions forming the ridge of the roof. The supporting beam 192 extends over the whole length so that the ends of the supporting beams 179 and 182 can be fastened thereto. Subsequently the roofing material 180 can be put over the distance 187 across the ends of the supporting beams 179, after which the three laths 186, omitted during the prefabrication, can be fastened. The roofing parts 183 and 180 are arranged in overlap as is shown in FIG. 27 in the same manner as is shown in FIG. 8. Then the tiles 193 can be laid and the ridge 194 can be mounted. As an alternative, the tiles 193 may be laid down on the roof portions 173 and 174 during the prefabrication, so that they are transported together with the section to the building site and there is no need for laying the tiles at the building site. On the building site it is then only necessary to put down the tiles over the distance 187. By constructing and transporting the roof portions as described above, the supporting beams 182 being arranged between the supporting beams 179 during the transport of the section, the roof portions can lie flat on the top of the portion 172. In this way the height 132 during transport is minimized and since the roof portions 173 and 174 overlap each other over the distance 230 the length 231 during transport is also at a minimum.

FIG. 28 shows schematically a further embodiment. The building section 201 of this embodiment has a parallelepiped-shaped portion 202 forming the space-bounding building part. Two roof portions 203 and 204 are arranged on the portion 202. The roof ridge 205 formed between the roof portions 203 and 204 is located asymmetrically with respect to the length 206 of the section 201. The roof portion 204 is fastened by means of a hinge 207 to the portion 202, this hinge corresponding in principle with the hinge comprising the hinge pins 32 of FIG. 9. THe roof portion 203 is fastened by means of a hinge 208 to the portion 202. The hinge 208 also corresponds in principle with the hinge shown in FIG. 9. The hinge 208 is constructed, however, so that the roof portion 203 can turn through an angle 209 about the hinge 208. The roof portion 203 can thus be arranged at the side of the wall 210 of the portion 202 as is shown by broken lines in FIG. 28, the roof portion 203 having a length 211 which corresponds approximately with the height 212 of the portion 202 of the building section. The roof portions 203 and 204 are constructed in principle in the same manner as the roof portions of the preceding embodiments so that details of supporting beams, roofing material and the like are not shown in detail. After the prefabrication the roof portion 204 is fastened by means of the hinge 207 to the prefabricated, parallelepiped-shaped portion 202 of the building section 201. For transporting the building section the roof portion 204 is put down on the top of the parallelepiped-shaped portion 202 in the position indicated by broken lines in FIG. 27 in the same manner as described with reference to the preceding embodiments. The construction shown in FIG. 27 permits of providing a section with a ridge not lying above the centre of the length of the section, whilst the section can, nevertheless, be provided with a roof during the prefabrication, this roof being tiltable so that the section has an over-all height 213 during transport which does not reduce the transportability of the section. The transport length 235 of the building section is comparatively small as compared with the dimensions of the space-bounding section portion 202.

The constructions illustrated in the preceding examples permit of prefabricating building sections whose dimensions in the final positions in the building (FIG. 1) are considerably larger than those during transport. The dimensions during transport are only slightly larger than or approximately equal to those of the space-bounding portion to which the roof portions are movably fastened because the roof portions can be arranged substantially completely along the sides of the space-bounding portion.

FIGS. 29 and 30 illustrate an embodiment in which a building section can be reduced in size for transport purposes so that it has essentially only half the size of its actual bulk. The building section 301 of FIGS. 29 and 30 has a lower building portion 302 forming a rigid unit and comprising a bottom wall 303, end walls 304 and 305 and a closed top wall 306. The bottom wall 303 with the end walls 304 and 305 and the top wall 306 constitute in principle the supporting part of the building section 302 and hence of the whole building section 301 for transport purposes. As in the preceding embodiments the section portion 302 may comprise a space-bounding beam skeleton along the sides of the parallelepiped-shaped portion 302. Although in this example the bottom wall 303, the end walls 304 and 305 and the top wall 306 are shown in the form of closed surfaces, one of these surfaces may, as desired, be left open wholly or partly to form a larger space together with other sections. The section portion 302 is provided on one side with a facade wall 307. This facade wall may be constructed so that, as desired, one or more windows or one or more doors are made therein. The side of the section portion located opposite the wall 307 is open so that a further section can be joined thereto. The two sections then form a larger room than one section could form. By means of hinges the section portion 302 is provided with end walls 309 and 310. These walls are located above the walls 304 and 305 in the final state of the building section in the building to be erected. The walls 309 and 310 are fastened by means of hinges 311 and 312 to the top of the section portion 302. Above the wall 307 a gable portion 313 is fastened by means of a hinge 314. The gable portion 313 covers a distance 315 which is considerably smaller than the over-all length 316 of the building section 301. In this embodiment the gable portion 315 is arranged at the centre of the length 316. To the top of the wall 310 is fastened by means of a hinge 317 a roof portion 318.

The walls 309, 310, 313, the top wall 306 of the section portion 302 and the roof portion 318 include a room located above the room of the section portion 302. The space bound by the walls 309, 310, 313 and 318 constitutes an enlargement of the room bounded by the section portion 302. The space bounded by the walls 309, 310, 313 and 318 may be used as a storey or part of a storey above the section portion 302. The building section 301 comprising the section portion 302 and the walls 309, 310, 313 and 318 movably fastened thereto constitute together an assembly which may form a two-storey building or part thereof. In the latter case the building section 301 joins further building sections of approximately the same shape, which together constitute the building. The building section 301 is prefabricated in the factory and for transport purposes it is folded together at least in part so that it occupies a smaller space. For transport purposes the wall portion 309 is tilted down on the top wall 306 so that it occupies the position indicated in FIG. 29 by broken lines. The gable portion 313 can be tilted around the hinge 314 so that it is located at the side of the wall portion 309 on the top wall 306, which is shown by broken lines in FIG. 29. Then the wall 310 can be tilted down into the position indicated by broken lines in FIG. 29. In this tilted position the wall portion 310 is located at the side of the gable portion 313. When the wall portion 310 is tilted down, the roof portion 318 turns about the hinge 317 with respect to the wall 310. The roof portion 318 is then located, as is indicated by broken lines in FIG. 29, on the gable portion 313 and the wall portion 309. The roof portion 318 thus projects by a distance 319 beyond the section portion 302.

For transport purposes the whole building section 301 is folded down so that it occupies a space which practically does not exceed the space occupied by the secion portion 302. The open parts 320 and 321 formed in the expanded state of the walls at the side of the gable portion 313 are filled with windows not shown in the Figures. These windows may be arranged with the frames on the building section and during transport of the section from the factory to the building site they can be conveyed on or in the space of the building section 301. For transport purposes these windows may be arranged on the bottom 303 in the section portion 302.

FIGS. 31, 32 and 33 show an embodiment of a bungalow 326. The building comprises five sections 327 to 331. Each of the sections 327 to 331, as in the preceding embodiments, comprises a space-bounding, box-shaped portion on which roof portions are movably arranged. The sections 329, 330 and 331 comprise each a box-shaped portion 332 with roof portions 333 and 334 arranged thereon similarly to the embodiment shown in FIGS. 1 to 13 so that further description may be omitted. The sections 327 and 328 are, in principle, identical with the embodiment shown in FIGS. 1 to 13, the sections 327 and 328 having, however, roof portions 335 and 336, which are longer by a distance 337 than the roof portion 333 of the section 331. The sections 327 and 328 also have roof portions 336 (FIG. 32) corresponding with the roof portion 334 (FIG. 31) and having the same length as the latter. The roof portion 336 is fastened by means of a hinge 338 to the parallelepiped-shaped section portion 339 in the same manner as is shown for the roof portion 18 of the first embodiment. The roof portion 335 is fastened to the portion 339 by means of sliding supports 340 as the roof portion 17 of the first embodiment. The connections 338 and 340 will therefore not be described further for this embodiment. The roof portion 335 has a length 341 exceeding the length of the roof portion 333 so that in the final position of the section 328 in the building a projecting part of the portion 335 is formed over the distance 337, beneath which, for example, a car may be parked. The end 342 of the portion 335 is held by a support 343. The support 343 is fastened by a hinge 334 to the prolonged part of the roof portion 335. Over a distance 337 of the end 342 a cover strip 345 is provided which corresponds with the cover strip 50 of FIG. 11. The cover strip 345 is fastened by means of a hinge 346 to the bottom of the roof portion 335. For transporting the building section 327 or 328 with the prolonged roof portion the roof portions 335 and 336 are arranged as is shown schematically in FIG. 33. In principle, this corresponds with the transport position of the sections of the first embodiment.

In this embodiment shown in FIG. 33 the support 343 is arranged, by turning about the hinge 344, on the bottom of the part of the roof portion 335 extending over the distance 337. The building section 327, like the building section 328, has a prolonged roof portion on one side. The prolonged roof portion 350 of the building section 327, together with the prolonged roof portion of the building section 328, constitutes a sufficiently large lean-to for accommodating a parked car. The roof portion 350 of the building section 327 is provided with supports 351 and 352, which can be tilted upwards for transports purposes in the same manner as described for the support 343.

When the sections are arranged in place, the joining edges of the roof portions 335 and 350 can be fastened to each other so that the lower end of the roof portion 335 is also held by the support 352 of the roof portion 350.

FIGS. 34 and 35 show a roof portion of an embodiment of the building which corresponds, in principle, with the building shown in FIG. 1. The building 375 of FIGS. 34 and 35 also comprises a plurality of adjacent building sections, only one of which (376) is shown in FIGS. 34 and 35. The section 376 comprises a parallelepiped-shaped lower portion 377 to which roof portions 378 and 379 are fastened. The roof portions 378 and 379 have a construction and a connection with the portion 377 completely similar to those shown for the roof portions 17 and 18 so that further description will be omitted. To the roof portion 378, however, is fastened a gable portion 380 of a construction differing from the gable portion 20 of the first embodiment. The roof portion 379 comprises a gable portion 381 corresponding with the gable portion 380. The gable portions 380 and 381 are mainly formed by a framework, the portion 380 having two vertical beams 382 and 383, which form the vertical edges of the gable portion 380. The gable portion 380 is provided on the lower side with a beam 384, which forms a framework with the beams 382 and 383 located beneath the edge 385 of the roof portion and having a wall 386 of concrete. A window 387 is provided in the wall portion 386. The gable portion 381 also has a skeleton of beams 388 and a concrete filling 389 located on the lower side of the edge of the roof portion 379. The skeleton 388 is provided with a vertical beam 391 which can be contacted and secured to the beam 383 on the building site. The gable portion 381 has a window 390 in the wall portion 389. For transporting the sections of the building shown in these Figures, for example, the section 376, the roof portions 378 and 379 are tilted down onto the top of the portion 376, whilst the gable portions 380 and 381 find their places at the side of the part 392 of the portion 376 in the manner shown for the gable portions 20 and 21 of the first embodiment.

Beams 393 are provided in the gable portion 392. These beams 393 are arranged so that the gable portions 380 and 381 can move along them when tilted down for transport purposes and move upwards for moving the roof portion and the wall portions into the final positions as shown in FIG. 34. When the roof portions and the wall portions 380 and 381 attached thereto are in their final positions, the lower beam 384 and the corresponding beam of the gable portion 381 can be secured to the beam 393 so that a satisfactory anchorage is obtained for the gable portions 380 and 381 and the parallelpiped-shaped portion 376.

Although the wall portions 380 and 381 together with the roof portions 378 and 379 are pivotally fastened to the parallelepiped-shaped portion 376, the wall portions 380 and 381 may, as an alternative, be separately fastened pivotally or movably in a different manner to the portion 376. The roof portions 380 and 381 may be fastened to the top of the portion 376 so as to be movable about a horizontal hinge shaft in the manner shown in the embodiment of FIGS. 29 and 30 for the wall portion 313. With a height 399 of the gable portions 380 and 381 not exceeding the width of the section portion 376 they can be lowered onto the top of the portion 376. The portions 380 and 381 can be tilted down together with the roof portions for transporting the building section.

FIGS. 36 and 37 show a further embodiment of a bungalow formed by sections. The embodiment shown in these Figures comprises a roof which is located symmetrically to the width 401 of the bungalow but which has at the ends inclined roof portions 402 and 403. The bungalow in this embodiment comprises five sections 404 to 408, The sections 405, 406 and 407 are each constructed as described in the first embodiment, each of them having a lower portion forming the space-bounding section portion on which two roof portions are arranged, which join each other. In view of the similarity with the first embodiment details of the sections 405 to 407 will not be described.

The sections 404 and 408 have each a roof portion differing from the preceding embodiments. The section 404 has two inclined roof portions 409 and 410, which are located, in the final positions of the sections shown in the Figures, in the same planes as the roof portions of the sections 405 to 407. The roof portions 409 and 410 are hinged to the lower portion 411 of the section 404 in the same manner as, for example, the roof portions of one of the preceding embodiments. The portion 402 forming a slanting end face of the roof may be prefabricated independently of the section and be fastened in position, at the building site, to the roof portions 409 and 410 after the latter have been erected in their slanting positions shown in the Figures. The roof portion 402 can be transported together with the sections as a separate unit. As an alternative, the inclined roof portions 409 and 410 may be hinged to the portion 411 and the portion 402 may also be hinged, for example, to the long side of the portion 411. The hinge shafts of the various portions 409, 410 and 402 may be arranged and the construction of these roof portions may be such that, for example, the roof portions 409 and 410 are laid down flat on the top of the portion 411, whilst the roof portion 412 can be tilted thereon, for transporting the section. The roof portion 402 has a length 412 exceeding the width 413 of the portion 411. In order to prevent the roof portion 402 from projecting beyond the width 413 during transport, this portion may be formed by two relatively pivotable parts, the hinge being arranged, for example, approximately along the line 414, so that the upper part 415 of the roof portion 402 can be tilted down onto the lower part 416 for transporting the section as a whole. The section 408 may be constructed in the same manner as described for the section 404.

FIGS. 38, 39 and 40 show an embodiment of a bungalow formed principally by two relatively off-set parts 425 and 426. The part 425 may comprise two building sections and the part 426, for example, three sections. Each of these sections may basically be similar to the sections of, for example, the first embodiment. The construction of this embodiment is, therefore, not further described. From FIG. 38 it will particularly be apparent that the part 425 has a facade portion 427 at the roof. The facade portion 427 comprises two portions 428 and 429 fastened to the roof portions 430 and 431 respectively of the building section 432 of the building part 425. The facade parts 427 and 429 may be secured to the roof portion in the same manner as described in the first embodiment for the gable portions 20 and 21. The facade parts 427 and 429 may be designed to form partly an outer wall and partly an inner wall. The inner wall parts are fastened to an upper part of the building part 426. This inner wall part, which joins the loft of the building part 426 may have an inner door so that the loft rooms above the building parts 425 and 426 communicate with each other. The facade portion of the building part 426, which joins the facade portion 427 may be constructed in the same manner as the facade portion 427.

FIGS. 41 and 42 show a further embodiment of a building formed by sections. This building comprises two portions 450 and 451, the part 451 comprising a plurality of box-shaped sections similar to the sections 2 to 6 of the first embodiment. These sections have a width 452 of, for example, about 12 ms. The roof arranged on the building part 451 is constructed in the same manner from roof portions similar to the roof portions 17 and 18 of the first embodiment. The building part 451 is joined by a part 450 having a width 453 which is considerably larger than the width of the part 452. The width 453 is about 18 ms. The part 450 comprises, for example, two building sections formed each by a parallelepiped-shaped lower portion of a length 453. On these lower portions roof portions 454 and 455 are arranged, whose construction is similar to that of the roof portions 17 and 18, their length being, however, larger than that of the roof portions 17 and 18. The length of the roof portions 454 and 455 is chosen so that the roof of the living part 450 is higher than the roof 457 of the building part 451. The width of the sections of the building 450, 451, as in the preceding embodiments, is about 2.50 ms. The width of the sections of the building may be larger, but the width preferably does not exceed 3 ms. The length of a section preferably does not exceed 20 ms. The facade portion 458 projecting above the roof 457 and joining the lower edges of the roof portions 454 and 455 is constructed in the same manner as the facade portion 427 in the embodiment shown in FIGS. 38 to 40.

Whilst various features of prefabricated building sections and methods of erecting them that have been described, and that are illustrated in the drawings, will be set forth in the following claims as inventive features, it is to be noted that the invention is not necessarily limited to these features and that it encompasses all of the features that have been described and illustrated both individually and in various combinations.

What we claim is:

1. A prefabricated parallelpiped space-bounding section for forming at least part of a building of a type which is adapted to be transported as a unit from a factory to the building site, the section comprising a plurality of boundary faces which define at least one parallelepiped shaped space of the section, a wall for defining a substantially complete side which extends along one-half or more of a further space of the building immediately above and adjacent to said one space, said wall being displaceably arranged on the section whereby for transport purposes it is arranged near one of said boundary faces of the section and is movable with respect to the section into a final position in the completed building, said wall in said final position being vertically disposed, having a vertical dimension at least one-half the height of said one space and defining a side of at least approximately one-half of said further space which is situated immediately above and adjacent said first mentioned space defined by said boundary faces, a further wall for defining another side of said further space which is disposed vertically at a right angle to said first mentioned wall in the completed building, said further wall being arranged for transport purposes near one of said boundary faces of the section and being movable with respect to the section into its final position in the completed building.

2. A section as claimed in claim 1 comprising pivot means wherein said wall is pivotally fastened to the section by said pivot means.

3. A section as claimed in claim 2, wherein a roof is displaceably fastened to said wall.

4. A section as claimed in claim 2, wherein the section has an elongated rectangular shape as seen from above and said pivot means is disposed along and parallel to a shorter side of said section.

5. A section as claimed in claim 2, wherein the section comprises a supporting framework of metal beams, said pivot means being mounted on said framework.

6. A section as claimed in claim 5, wherein a concrete floor is arranged between said metal beams of the supporting framework at the bottom of the section.

7. A section as claimed in claim 6, wherein the section comprises a plurality of concrete walls.

8. A section as claimed in claim 7, wherein the section has a width in the range of 2.50 to 3.00 meters and a length in the range of 10 to 12 meters.

9. A section as claimed in claim 8, wherein the section has a height of about 3 meters.

10. A section as claimed in claim 5, wherein said pivot means comprises hinges by means of which said wall is fastened to one end of the section.

11. A section as claimed in claim 10, wherein said hinges are directly fastened to said supporting framework of metal beams.

12. A section as claimed in claim 5, including hinge means mounted on said framework of beams pivotally connecting said wall to the section, said wall extending beyond said hinge means on both sides thereof.

13. A section as claimed in claim 12, wherein a pair of said hinge means are provided, one of said hinge means being provided at each end of said section.

14. A section as claimed in claim 1, wherein the top part of the section comprises a loft floor and a ceiling lying beneath said loft floor.

15. A section as claimed in claim 1, wherein the maximum height of both said walls is substantially the same as the height of the section.

16. A prefabricated elongated parallelepiped space-bounding section for forming at least part of a building, the section being of a type which is adapted to be transported as a unit from a factory to a building site, the section comprising: a floor component; a wall panel; and a ceiling member, the upper side of said ceiling member comprising a further floor component; said first mentioned floor component, said wall panel and said ceiling member comprising boundary faces for a first space in the section; a roof and a further wall panel connected to a short side of the section, said further wall panel being pivotally connected in the section so as to pivot relative to said further floor component whereby said further wall panel is adapted to be in a lowered position along the side of said first space when the section is being transported and thereafter pivoted to its vertically disposed final position at the building site; said roof being displaceably fastened to said further wall panel whereby said further wall panel, said further floor component and said roof completely define three sides of a second space immediately over and adjacent said first space when situated in their final positions at the building site, said second space having a height at least one-half of said first space.

17. A prefabricated elongated parallelepiped space-bounding section for forming at least part of a building, the section being of a type which is adapted to be transported as a unit from a factory to a building site, the section comprising: a floor component; a wall panel; and a ceiling member; said floor component, said wall panel and said ceiling member comprising boundary faces for a first space in the section; a roof connected to a shorter side of the section and a further wall panel having a height of at least one-half of the height of said first wall panel which are rigidly connected together in a fixed relationship and are displaceably arranged in the section so as to be movable relative to said ceiling member whereby said further wall panel is adapted to be in a lowered position when the section is being transported and moved to its vertically disposed final position at the building site where and said further wall panel and said roof above said ceiling member define a second space with a height at least one-half the height of said first space immediately above and adjacent said first space.

18. An elongated prefabricated box-shaped parallelepiped space-bounding section for forming at least part of a building, the section being of a type which is adapted to be transported as a unit from a factory to a building site, the section comprising: a supporting framework of metal beams, a floor component mounted between the lower metal beams of said framework; a wall panel mounted between vertical beams provided in said framework; and a ceiling component mounted between further metal beams of said framework; said floor component, said wall panel and said ceiling member comprising boundary faces for a first space within said framework; a roof and a further wall panel having a height at least one-half the height of said first-mentioned wall panel which are hingedly connected together and to at least one beam of said further metal beams so as to be displaceable relative to said ceiling member whereby said roof and said further wall panel are adapted to be in a lower position when the section is being transported and said wall panel is adapted to be moved to a vertically disposed final position and said roof is adapted to be raised at the building site where said further wall panel and said roof define a second space immediately above said ceiling member over said first space.

19. A prefabricated elongated parallelpiped space-bounding section for forming at least part of a building, the section being of a type which is adapted to be transported as a unit from a factory to a building site, the section comprising: a floor component; a wall panel; and a ceiling member; said floor component, said wall panel said ceiling member comprising boundary faces for a first space in the section, a roof and a further wall panel rigidly connected together and displaceably arranged in the section so as to be movable relative to said first space, said further wall panel having a height at least one-half the height of said first-mentioned wall panel and adapted to be in a lowered position for being transported to the building site which falls within a plane parallel and adjacent to a longer vertical boundary face for said first space and to be raised as a whole while substantially entirely contained within said plane at the building site whereby said further wall panel and said roof in the raised position define a second space immediately above said ceiling member and over said first space.

20. A section as claimed in claim 19, wherein the height of said further wall is substantially the same height as said first mentioned wall.

21. A prefabricated parallelepiped box-shaped space-bounding section for forming at least part of a building, the section being of the type which is adapted to be transported as a unit from a factory to a building site, the section comprising: a floor component; a wall panel; and a ceiling member, said floor component, said wall panel and said ceiling member comprising boundary faces for a box-shaped space in the section; a gable portion which has substantially the shape of a right angled triangle being pivotally connected to an upper part of the section so as to be pivotable about an axis relative to one of its corners other than the right angle corner from a position wherein the hypotenuse of the triangle is moved from a substantially horizontal position with said gable portion disposed at the side of said space for transportation purposes to an inclined position above said space at the building site wherein the other sides of the triangle are placed in vertical and horizontal disposition in the completed building, said axis being horizontally disposed and substantially perpendicular to said gable portion, said side of said triangle placed in vertical disposition having a length equal to more than one-half of the height of said box-shaped space.

22. A section as claimed in claim 21, wherein the entire said gable portion remains substantially in a vertical plane relative to said space during such movement while being pivoted about an axis substantially perpendicular to said plane.

23. A section as claimed in claim 22, wherein a roof is rigidly connected in a fixed relationships to the side of said gable portion corresponding to said hypotenuse.

24. A section as claimed in claim 23, wherein a further gable portion similar to said first mentioned gable portion is provided which is similarly pivotable relative to said space, said gable portions when raised at the building site having their right angle corners adjacent to each other.

25. A section as claimed in claim 21, wherein a further floor component is included at the top of said ceiling member and a roof is provided along the hypotenuse side of said gabel portion, said further floor component, said roof and said gable portion when in raised position at the building site at least one-half of defining an attic space over said box-shaped space.

26. A section as claimed in claim 85, including a roof structure, said gable portion comprising a wall, said wall being rigidly connected with said roof structure.

27. A section as claimed in claim 26, wherein said wall constitutes an outer wall of the completed building.

28. A section as claimed in claim 27, wherein said wall is fastened at its top edge to said roof structure to form an angle therebetween of about, 90°.

29. A section as claimed in claim 28, wherein said wall includes windows.

30. A section as claimd in claim 27, wherein said outer wall is comprised substantially of wood.

31. A section as claimed in claim 27, wherein said roof structure projects beyond said outer wall.

32. A section as claimed in claim 27, wherein said outer wall comprises vertically disposed wooden portions and at least one window.

33. A section as claimed in claim 26, wherein said wall consists of an inner wall for a loft and said roof structure is rigidly secured to said inner wall.

34. A section as claimed in claim 26, wherein said wall includes doors which are inner doors.

35. A section as claimed in claim 26, wherein said roof structure forms a saddle type roof.

36. A section as claimed in claim 26, wherein said wall comprises two portions which are adapted to be displaced outwardly from each other for transport purposes.

37. A section as claimed in claim 36, wherein said portions of said wall are displaceable with respect to the section in a direction of length.

38. A section as claimed in claim 26, wherein said wall is slideable relative to the section.

39. A section as claimed in claim 26, wherein said wall is composed of a concretive material.

40. A prefabricated parallelepiped box-shaped space bounding section for forming at least part of a building, the section being of a type which is adapted to be transported as a unit from a factory to a building site, the section comprising: a floor component; a wall panel; and a ceiling member; said floor component, said wall panel and said ceiling member comprising boundary faces for a box-shaped space in the section; a gable portion which has substantially the shape of a right angled triangle being pivotally connected in an upper part of the section so as to be pivotable relative to one of its corners other than the right angle corner from a position wherein the hypotenuse of the triangle is moved from a substantially horizontal position with said gable portion disposed at the side of said space for transportation purposes to an inclined position above said space at the building site, the entire said gable portion remaining substantially in a vertical plane relative to said space during its movement while being pivoted about an axis substantially perpendicular to said plane, a roof rigidly connected to the side of said gable portion corresponding to said hypotenuse, a further gable portion similar to said first mentioned gable portion being provided which is similarly pivotable relative to said space, said gable portions when raised at the building site having their right angle corners adjacent to each other, hinge means in the upper portion of the section being provided wherein one of said gable portions is hingedly connected to said section whereby it pivots about said hinge means when raised, the pivot axis of the other said gable portion being movable relative thereto when it is raised.

41. A prefabricated parallelepiped space-bounding section for forming at least part of a building of a type which is adapted to be transported as a unit from a factory to the building site, the section comprising a plurality of boundary faces while define at least one parallelepiped shaped space of the section, a wall which in the completed building has a height at least one-half the height of said space for defining a further space of the building immediately above and adjacent to said one space, said wall pivotably arranged on the section whereby for transport purposes it is arranged near one of section boundary faces of the section and is movable with respect to the section into a final position in the completed building, said wall being pivotally connected to a roof portion, said wall and said roof portion in said final position at the building site defining at least in part said further space which is situated immediately above and adjacent said first mentioned space defined by said boundary faces.

42. A prefabricated parallelepiped box-shaped space-bounding section for forming at least part of a building of a type which is adapted to be transported as a unit from a factory to the building site, the section comprising a plurality of boundary faces which define the outer boundaries of the parallelepiped shaped space of the section, a wall for bounding a further space immediately superimposed above said first mentioned space, said wall having a height at least one-half of the height of said first mentioned space and being displaceably arranged on the section by pivot means having a horizontal axis which is provided to connect said wall to said section whereby for transport purposes said wall is arranged along one of said boundary faces of the section and is pivotable with respect to the section upwardly through an angle of about 180° into its final vertically disposed position in the completed building wherein said wall defines in part said further space immediately above said first mentioned space.

43. A section as claimed in claim 41, including a framework of beams for the section, wherein three said walls are provided, each of which is pivotally fastened by said pivot means to said framework of beams of the section.

44. A section as claimed in claim 42, wherein said pivot means comprise three hinges, one of which has a pivotal axis which crosses the pivotal axes of the other two hinges.

45. A prefabricated elongated parallelepiped space-bounding building section for forming at least part of a building, the section being of a type which is adapted to be transported as a unit from a factory to the building site, the section comprising: a floor component; a wall panel; and a ceiling member; said floor component, said wall panel and said ceiling member comprising boundary faces for a box-shaped space in the section; the top part of the section comprising a further floor lying above said ceiling member, a gable portion being pivotally connected in an upper part of the section by pivot means extending along a longer side of the section so as to be pivotable from a position wherein it is lying on the further floor for transport purposes to a vertically extending final position above said space at the building site, a pair of wall portions each of which is pivotally connected by pivot means extending along opposite shorter sides of the section so as to be pivotable from positions parallel to said further floor for transport purposes to a vertically extending final position at right angles to said gable portion above said space at the building site, said further floor, said wall portions and said gable portion forming boundary surfaces in the completed building for a further space which is situated immediately above and adjacent said first mentioned space defined by said boundary faces.

46. A prefabricated parallelepiped space-bounding section for forming at least part of a building of a type which is adapted to be transported as a unit from a factory to the building site, the section comprising a plurality of boundary faces which define at least one parallelepiped shape space of the section, a wall for defining a substantially complete side which extends along one-half or more of a further space of the building immediately above and adjacent to said one space, said wall comprising two wall portions, one said wall portion being fastened by hinge means to the section and the other said wall portion being pivotally connected with said one portion, said two wall portions being adapted to be displaced outwardly relative to each other for transport purposes whereby when so displaced they are each arranged near one of said boundary spaces of the section and are each movable with respect to the section into a final position in the completed building, said wall portions in said final position upon being vertically disposed having a vertical dimension of at least one-half the height of said one space, and a roof structure being provided which is rigidly connected with at least one of said wall portions.

47. A prefabricated parallelepiped space-bounding section for forming at least part of a building of a type which is adapted to be transported as a unit from a factory to the building site, the sections comprising a plurality of boundary faces which define at least one parallelepiped shaped space of the section, a wall for defining a substantially complete side which extends along one-half or more of a further space of the building immediately above and adjacent to said one space, said wall being displaceably arranged on said section whereby for transport purposes it is arranged near one of said boundary faces of the section and movable with respect to the section into a final position in the completed building, said wall in said final position being vertically disposed, having a vertical dimension at least one-half the height of said space and defining a side of at least approximately one-half of said further space which is situated immediately above and adjacent said first mentioned space defined by said boundary faces, a pair of pivot means, a framework of beams for the section, and a roof, said wall being pivotally connected at its lower edge with said framework of beams and at its top edge with said roof.

* * * * *